US005832336A

United States Patent [19]

Kawasaki et al.

[11] Patent Number: 5,832,336

[45] Date of Patent: Nov. 3, 1998

[54] IMAGE FORMING APPARATUS

[75] Inventors: Akihiro Kawasaki; Koji Uno; Tamotsu Sakuraba; Hiroyuki Maeda, all of Toyokawa, Japan

[73] Assignee: Minolta Co., Ltd., Osaka, Japan

[21] Appl. No.: 788,316

[22] Filed: Jan. 24, 1997

[30] Foreign Application Priority Data

| | | | |
|---|---|---|---|
| Jan. 26, 1996 | [JP] | Japan | 8-011737 |
| Dec. 19, 1996 | [JP] | Japan | 8-339477 |
| Dec. 19, 1996 | [JP] | Japan | 8-339482 |

[51] Int. Cl.[6] ..... G03G 15/00; G03G 15/30

[52] U.S. Cl. ..... 399/71; 399/50; 399/149

[58] Field of Search ..... 399/357, 353, 399/354, 149, 71, 50

[56] References Cited

U.S. PATENT DOCUMENTS 5,592,266 1/1997 Park et al. ..... 399/149 X 5,610,697 3/1997 Arai ..... 399/149

FOREIGN PATENT DOCUMENTS 4-371975 12/1992 Japan .

4-371976 12/1992 Japan .

*Primary Examiner*—S. Lee

*Attorney, Agent, or Firm*—McDermott, Will & Emery

[57] ABSTRACT

Developer material remaining on an image bearing member after transfer are collected by a developer. A cleaning member is arranged between a charger and an exposure in contact with the image bearing member, for collecting the residual developer material. A bias controller controls biases to be applied to a cleaner, a charger, and a developer. During an image forming process, the biases are so determined that the residual toner on the image bearing member is collected by the cleaner. While the image forming process is not performed, the biases are so determined that the collected toner is removed from the cleaner to the image bearing member and then collected by the developer.

16 Claims, 17 Drawing Sheets

●: INITIAL CHARGE OF WRONG SIGN TONER

1ST COLLECTING PROCESS

IMAGE FORMING APPARATUS

FIELD OF THE INVENTION

The present invention relates to an image forming apparatus. More specifically, the present invention relates to an improvement for recovering residual developer materials which still remain adhering to an image bearing member after transfer from its surface.

BACKGROUND OF THE INVENTION

Typically, in an electrophotographic image forming apparatus as for example a copy machine, an electrostatic latent image formed on an image bearing member is visualized by a developer which uses developer materials, i.e., toner particles, into a toner powder image. Then the visualized toner powder image is transferred onto a receiving substrate such as paper. During this transfer, the toner powder image is not completely transferred to the receiving substrate and invariably some toner particles remain adhering to the image bearing member.

To collect such residual developer material from the image bearing member into the developer for its reclaim, image forming devices disclosed in Japanese Laid-Open Publications Nos. 4-371975 and 4-371976 include a scattering and a charging brushes placed in contact with respective portions of the image bearing member that have passed across a transfer station.

In this arrangement, the scattering brush is biased to a potential of +500 volts so that the surface of the image bearing member is positively charged to +100 volts by the contact therewith. The device employs toner particles which should to be negatively charged by the contact of charging means, and therefore the residual toner particles remaining on the image bearing member after transfer are electrically attracted by the positively charged scattering brush. The attracted toner particles are then positively charged by the scattering brush, causing the toner particles to electrically repel against the scattering brush and return to the surface of the image bearing member.

The charging brush on the other hand is biased to a potential of −1,200 volts, thereby the positively charged toner particles are electrically attracted to the charging brush. The attracted toner particles are then negatively charged again by the contact with the negatively charged charging brush, causing the toner particles to repel against the charging brush to return to the surface of the image bearing member. At this time, by the contact with the charging brush, the successive surface portions of the image bearing member are charged to a potential of −500 volts.

Subsequently, the surface of the image bearing member advances to a development station. At the development station, a toner bearing member is arranged adjacent the image bearing member. The toner bearing member is biased to a potential of −200 volts which is relatively higher than the potential of the image bearing member by +300 volts, allowing the negatively charged residual toner particles to be attracted to and collected by the toner bearing member for reclaim.

As described, in those image forming devices, the charging brush is needed to perform three functions, a first function to charge the image bearing member, a second function to attract the positively charged residual toner particles, and third function to charge the attracted toner particle and reverse its polarity. Additionally, these functions should be carried out in a relatively short period of time or almost simultaneously. Disadvantageously, the residue invariably includes some wrong sign toner particles charged opposite in polarity, i.e., positively charged toner particles. Therefore, an increase of the residue would make it difficult to collect all the residual toner particles by the charging brush. As a result, a number of uncollected toner particles are disadvantageously transported to an exposure station, causing a light of image projected onto the surface of the image bearing member for forming the electrostatic latent image thereon to be blocked. This in turn results in a light and dark irregularities and unwanted small spots in a resultant image.

SUMMARY OF THE INVENTION

In accordance with the invention there is provided an improved image forming apparatus for removal of developer material from image bearing member and reclaim it.

In accordance with one aspect of the invention, an image forming apparatus includes an image bearing member, charging means for charging the image bearing member, exposure means for exposing the charged image bearing member to form an electrostatic latent image thereon, developing means for bringing a developer material into contact with the image bearing member to develop the electrostatic latent image into a visualized image using developer material having the same electric charge as the image bearing member, and transfer means for transferring the visualized image to a receiving substrate. Further, the apparatus includes cleaning means arranged between the charging means and the exposure means in contact with the image bearing member for collecting the residual developer material remaining on the image bearing member, biasing means, and controlling means for controlling the biasing means to apply a charging bias, a cleaning bias, and a development bias to the charging, cleaning, and development means, respectively. When an image forming process is carried out in the image forming apparatus, the charging bias is so set that the image bearing member is charged to a certain potential and further the residual toner particle on the image bearing member is charged to the same polarity as the potential of the image bearing member. Besides, the cleaning bias is so set that it has the same polarity as and smaller absolute value than those of the potential of the image bearing member for collecting the residual developer material from the image bearing member to the cleaning means.

With this improvement, in the image forming process, the residual developer material remaining on the image bearing member after transfer is charged by the charging means to the same polarity as the image bearing member. The cleaning means on the other hand is biased to the potential having the same polarity of the image bearing member, the absolute value thereof being smaller than that of the image bearing member. This allows the cleaning means to attract and collect the residual developer materials from the image bearing member.

In accordance with another aspect of the invention, when the image forming process is not carried out in the apparatus, the cleaning bias is so set that it has the same polarity as and greater absolute value than those of the potential of the image bearing member. This allows the toner particles on the cleaning means to be removed from the image bearing member. Further, the developing bias is so set that it has the same polarity as and smaller absolute value than those of the charge potential of the image bearing member. This allows the toner particles on the image bearing member to be collected by the developing means.

Therefore, no developer material is transported to an exposure station, which prevents a light of image to be exposed on the image bearing member from being blocked by the residual developer material. This ensures that the image forming apparatus will form a high quality image free from defects. Also, the collected developer material will be reclaimed in the subsequent development.

In accordance with still another aspect of the invention, the image forming apparatus includes a first charging member and a second charging member arranged on downstream side of the first charging member with respect to a rotational direction of the image bearing means. The apparatus further includes and a power supply means for supplying a first and a second biases to the first and second charging means, respectively. Each of the first and second biases consists of a pulse wave in which a maximum and a minimum potentials are repeated alternately. Also, in the first bias, a duration of the maximum potential is longer than that of the minimum potential. In said second bias, on the other hand, a duration of the maximum potential is shorter than that of the minimum potential.

With this improvement, since the duration of the maximum potential is longer than that of the minimum potential, the developer material remaining on the image bearing member after transfer is collected when the maximum potential is charged to the charging members. Also, as the maximum and minimum potentials are alternately applied to the first charging member, the developer material on the image bearing member is effectively scattered in all directions, thereby an image memory formed by the residual developer material can be dissipated. On the other hand, since the duration of the maximum potential is shorter than that of the minimum potential, the residual developer material not collected by the first charging member can be collected by the second charging member. Also, the second charging member eliminates voltage variations on the image bearing member created by the first charging bias and/or by removing the developer materials from the image bearing member by the first charging member, which allows the image bearing member to bear an even charge thereon after charging.

In accordance with yet another aspect of the invention, an image forming apparatus includes an image bearing member, first charging means for charging the image bearing member, exposure means for exposing the charged image bearing member to form an electrostatic latent image thereon, developing means for developing the electrostatic latent image into a visualized image, transfer means for transferring the visualized image to a receiving member, and collecting means for collecting the developing material remaining on the image bearing member after transfer but before charging. According to this improvement, in image forming process, the first charging means provides the image bearing member and the residual developing material with an electric charge having a specific polarity. Also, the collecting means is biased to a potential that provides the image bearing member with the similar electric charge. The potential further has an absolute value lower than that of the image bearing member so that the residual developing material is collected by the collecting means.

When the image forming process is not carried out, the collecting means is biased to a certain potential having an absolute value greater than that of the electric charge of the image bearing member so that the developer material collected by the collecting means is returned to the image bearing member and then collected by the development means.

Preferably, in the image forming process, a voltage difference between the collecting means and the image bearing means is set to be greater than that required for bringing about a discharge therebetween. In this instance, the surface of the image bearing member is discharged to a certain potential and voltage variations created when collecting the developer material by the collecting means are completely eliminated.

In addition, with an improvement in which a second discharging means is arranged between the collecting means and exposure means, by setting an absolute value of a bias to be charged to the second charging means greater than that of the first charging means, the voltage variations can further be eliminated.

Each of the first and second charging means may be the one that contacts with the image bearing member. In this instance, to avoid the developer material from being accumulated thereon, a scraper is preferably provided to keep the charging means clean. More preferably, on the upstream side of the charging means with respect to the moving direction of the image bearing member, a precharging means is provided for precharging the developer material to the desired polarity before its contact with the charging means.

In accordance to still another aspect of the invention, an image forming apparatus for reclaiming a residual developer material includes a rotatable image bearing member supporting an endless image bearing surface, first charging means arranged in contact with the image bearing surface for imparting a first electric charge to the image bearing surface, second charging means arranged on a downstream side of the first charging means with respect to a rotational direction of the image bearing member in contact with the image bearing surface for imparting a second electric charge having the same polarity as the first electric charge to the image bearing surface, exposure means for exposing the charged image bearing surface to form an electrostatic latent image thereon, developing means which includes a developer material having the same polarity as the electric charge on the image bearing surface so that the electrostatic latent image is developed by the developer material into a visualized image on the image bearing surface, transfer means arranged between the development means and the first charging means for transferring the visualized image to a receiving member.

In this arrangement, the second electric charge imparted by the second charging means to the image bearing surface is preferably higher than the first electric charge imparted by the first charging means thereto.

Also, either or both of the first and second charging means may be a roller-type or brush-type electric charger.

Further, either or both of the first and second charging means collect said developer material which remains on the image bearing surface after transfer, and the second charging means collects more developer material than the first charging means.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

PREFERRED EMBODIMENT OF THE INVENTION

(a) FIRST EMBODIMENT

Figure 1:
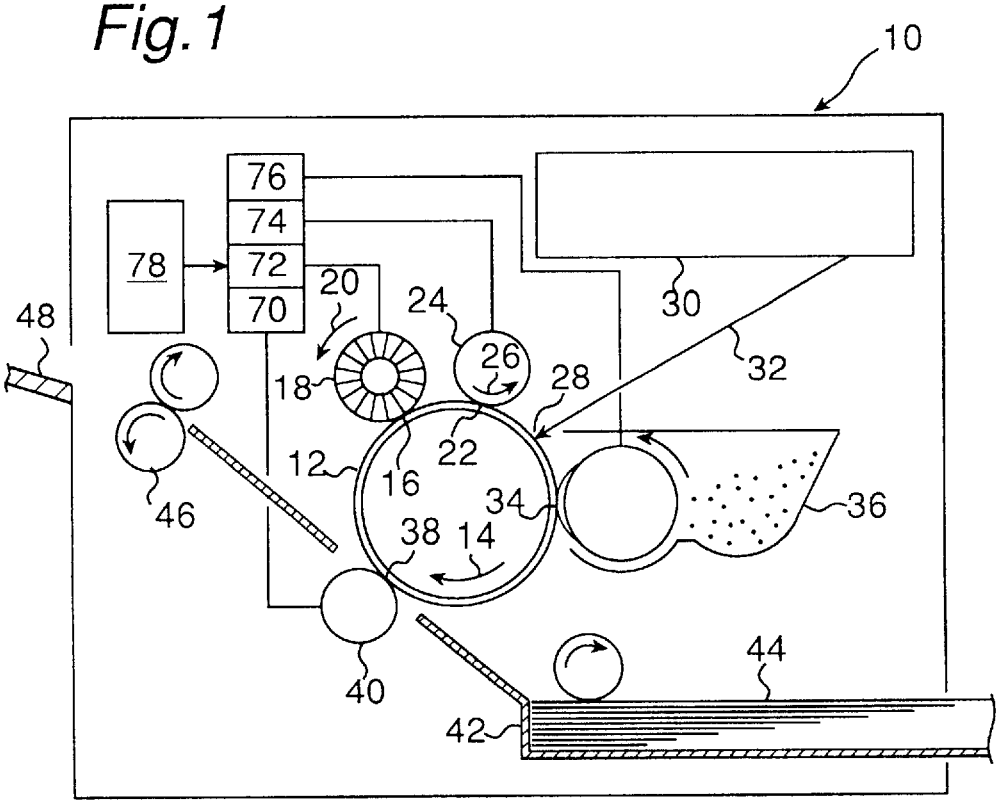
FIG. 1 is a sectional view of an image forming device of the first embodiment according to the invention.

Referring now to FIG. 1, there is shown an image forming device of the first embodiment according to the invention generally indicated by reference numeral 10. Firstly, a brief discussion will be made to an image forming operation thereof together with its structure. The image forming device 10 includes a image bearing member or a photoconductive drum 12. Once the image forming operation is started, drum 12 rotates in the direction of arrow 14 to advance successive circumferential portions thereof through various processing stations arranged around drum 12.

Initially, the surface portion of drum 12 advances to a charging station 16. At charging station 16, a charging brush 18 is mounted for rotation in the direction of arrow 20 in circumferential contact with drum 12, thereby the surface portion of drum 12 is charged to a specific potential by the contact with charging brush 18. Then, the charged surface portion moves into a cleaning station 22. At cleaning station 22, a cleaning roller 24 is mounted for rotation in the direction of arrow 26 to remove residual toner particles remaining on drum 12. The removing process will be described in detail hereinafter. Subsequently, the surface portion of drum 12 advances to an exposure station 28 where it is exposed to a light of image 32 such as laser light projected from a light emitting unit 30 to selectively dissipate the charge thereon, thereby forming an electrostatic latent image. The latent image is carried to a development station 34 where it is visualized into a toner powder image by a suitable developer. Finally, the surface of drum 12 bearing the visualized image advances to a transfer station 38. At transfer station 38, a transfer roller 40 is arranged adjacent drum 12 by which the toner powder image is transferred to a receiving substrate such as paper 44 fed from a sheet feeder 42. Sheet 44 is then transported to a fusing station 46 where the transferred toner image is affixed thereto and then discharged to a catch tray 48 or finishing station. After transfer, the drum portion moves again into charging station 16 where it is charged for the next image forming.

Figure 2:
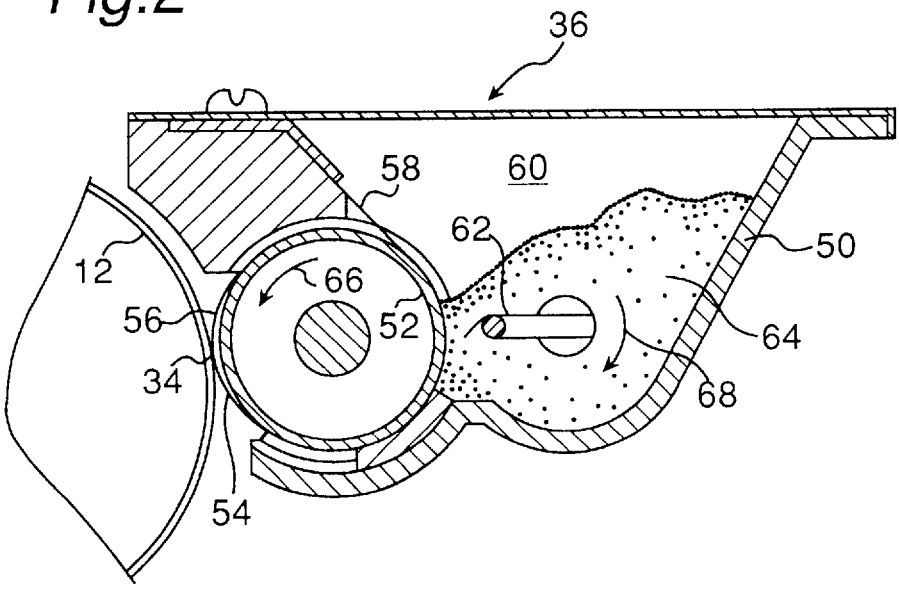
FIG. 2 is a sectional view of a developer preferably incorporated in the image forming device shown in FIG. 1.

Although any conventional developing means is available, a developer 36 shown in FIG. 2 is preferably employed in the invention. Developer 36 has a housing 50 in which a roller 52 is included adjacent drum 12. Roller 52 is surrounded at its outer surface by a developing sleeve 54 in the form of cylinder, an inner diameter thereof being slightly greater than an outer diameter of roller 52. Sleeve 54 is Preferably formed from a thin and thereby flexible member. A portion of sleeve 54 away from drum 12 is placed in close contact with roller 52 by biasing members (not shown) disposed adjacent both sides of sleeve 54, thereby a remaining portion of sleeve 54 facing to drum 12 is spaced apart from roller 52 to form a convex portion 56. Convex portion 56 of sleeve 54 is brought into circumferential contact with the outer periphery of drum 12. On the opposite side of sleeve 54, a blade 58 in the form of plate is arranged adjacent sleeve 54. Blade 58 has a proximal extremity secured to housing 50 and a distal extremity in contact with the outer periphery of sleeve 54. Housing 50 has a chamber 60 for accommodating of toner particles 64, adjacent roller 52 but away from drum 12, in which a paddle 62 is mounted for rotation.

In operation, roller 52 and paddle 62 are rotated in respective directions of arrows 66 and 68 by a motor (not shown) drivingly coupled thereto. Thereby, toner particles 64 in chamber 60 are stirred and conveyed towards roller 52 by the rotation of paddle 62. Since sleeve 54 is partially in contact with roller 52, it is driven to rotate in the direction of arrow 66 by a friction force generated therebetween, which in turn allows toner particles 64 adjacent sleeve 54 to be transported in the same direction. Toner particles 64 are then transported to a contact region of sleeve 54 and blade 58. At the contact region, an amount of toner particles to be transported by sleeve 54 is adjusted or restricted. Also, toner particles are provided with a triboelectric charge by the frictional contact with blade 58. Therefore, a portion of sleeve 54 which has moved past the contact region carries a thin layer of charged toner particles 64. Toner particles 64 thus retained on sleeve 54 are then transported by the movement thereof to development station 34 where they are electrically attracted to drum 12 to eventually develop the latent into a visualized image. As is well known in the art, the development by toner particles 64 is accomplished by the electrical attraction of an electrostatic field formed between drum 12 and sleeve 54.

Discussions will be made to the collecting operation of the residual toner particles from drum 12 to developer 36. The collecting operation is performed in two processes In the first collecting process, which is performed simultaneously with the above described image forming process, the residual toner particles remaining on drum 12 after transfer are collected by cleaning roller 24. In the subsequent second collecting process, which is performed when the image forming process is not performed, the toner particles collected by cleaning roller 24 is returned to drum 12 and then re-collected by developer 36 for reclaim. The give and take of the toner particles in these processes are electrically controlled by bias potentials applied to charging brush 18, cleaning roller 24, and sleeve 54 with respect to the charge potential of drum 12.

For this purpose, image forming device 10 has four D.C. power sources, i.e., transfer bias supply 70, charging bias supply 72, cleaning bias supply 74, and development bias supply 76. These bias supplies 70 to 76 are electrically connected to a bias controller 78 so that, if the toner particles to be negatively charged by the contact with blade 58 are employed, outputs of bias supplies 70 to 76, i.e., transfer bias V1, charging bias V2, cleaning bias 74, and development bias V4, are controlled depending upon the collecting processes as shown in the following Table 1. It should be appreciated that each of bias supplies can be turned off when the image forming device is in a standby state in which neither collecting processes is carried out.

TABLE 1

| | 1ST COLLECTING PROCESS | 2ND COLLECTING PROCESS |
|---|---|---|
| V1 | +400 volts | +400 volts |
| V2 | −1,200 volts | −1,200 volts |
| V3 | −400 volts | −1,200 volts |
| V4 | −300 volts | −300 volts |
| V0 | −700 volts | −700 volts |

Figure 3A:
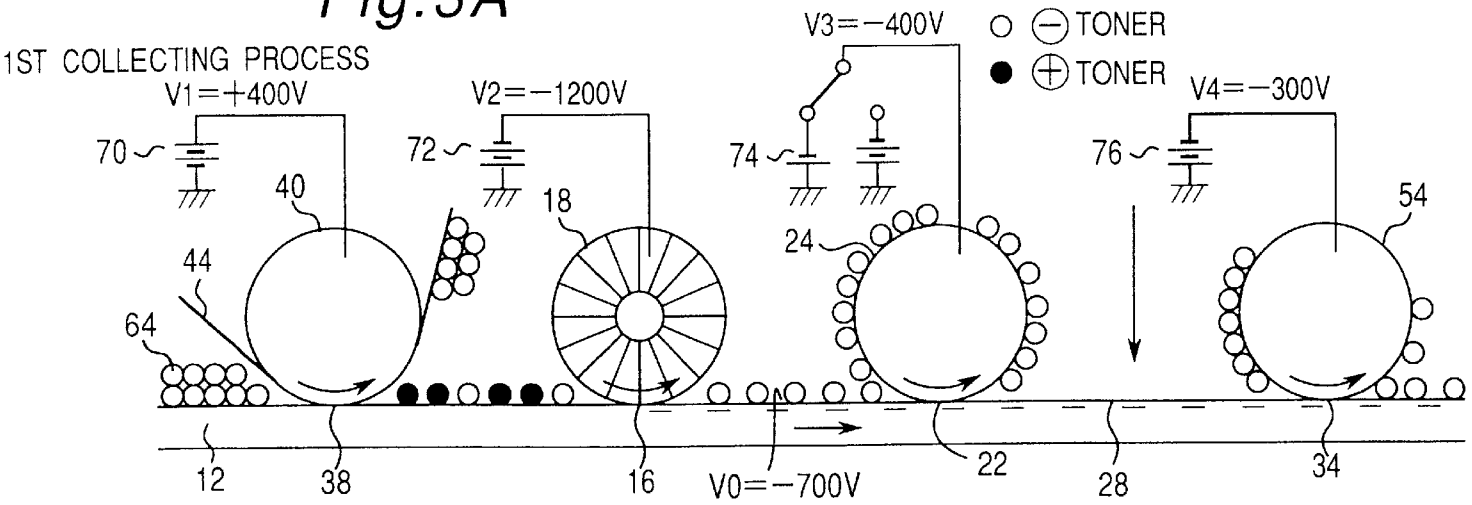
FIG. 3A shows a first collecting process of the first embodiment in which residual toner particles are collected by a cleaning roller.

FIG. 3A illustrates the first collecting process in the image forming in which residual toner particles 64 on drum 12 are collected by cleaning roller 24. In this process, as shown in Table 1, biases V1, V2, V3, and V4 are set to +400 volts, −1,200 volts, −400 volts, and −300 volts, respectively. Thereby, at transfer station 38, negatively charged residual toner particles 64 on drum 12 are transferred to sheet substrate 44 by the attraction of transfer roller 40 which is biased to V1 of +400 volts. During this transfer process, although most toner particles adheres to sheet substrate 44, some toner particles invariably remain adhering on drum 12. Disadvantageously, although the device employs toner particles to be negatively charged, the residue invariably includes wrong sign toner particles charged oppositely in polarity, i.e., positively charged toner particles.

Residual toner particles 64 are then transported to charging station 16. At charging station 16, charging brush 18 is biased to V2 of −1,200 volts. This takes place a discharge between charging brush 18 and drum 12, which charges successive surfaces of drum up to a potential of about −600 to −900 volts. In this embodiment, let it be assumed that the surface of drum 12 is to be charged to V0 of −700 volts. At the same time, charging brush 64 also imparts negative charge to residual toner particles 64. By this charging, even the wrong sign toner particles are negatively charged.

Next, negatively charged residual toner particles 64 are then transported to cleaning station 22. At cleaning station 22, cleaning roller 24 is biased to V3 of −400 volts which is relatively higher than the surface potential V0 of −700 volts on drum 12 by +300 volts. This allows negatively charged residual toner particles 64 to be electrically attracted to and collected by the cleaning roller 24.

Due to the first collecting process, no residual toner particles will be transported to exposure station 28 during the image formation thereby preventing the image light blocking which would otherwise result if the residual toner particles are transported to the exposure station. This ensures that the desired electrostatic latent image conforming to an original image is formed by the exposure of image light, which permits a reproduction of the image having no defect, spot, or density variation.

Figure 3B:
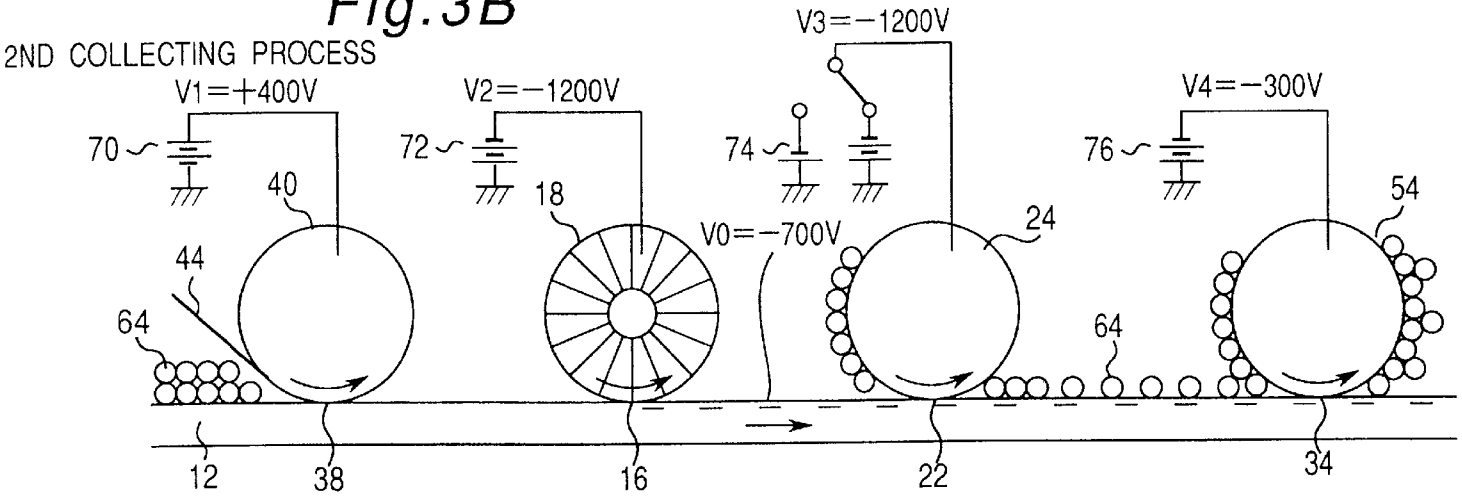
FIG. 3B shows a second collecting process of the first embodiment in which residual toner particles are collected by a developer.

FIG. 3B illustrates the second collecting process in which residual toner particles 64 on cleaning roller 24 are removed therefrom to drum 12 and then re-collected by developer 36. As shown in Table 1, in this second collecting process, biases V1, V2, V3, and V4 are set to +400 volts, −1,200 volts, −1,200 volts, and −300 volts, respectively. Alternatively, the transfer bias V1 may be turned off.

In this instance, because drum 12 is charged to V0 of −700 volts while cleaning roller 24 is biased to V3 of −1,200 volts and thereby drum 12 electrically higher than cleaning roller 24 by +500 volts, negatively charged toner particles 64 are electrically attracted to drum 12. Toner particles 64 caught by drum 12 is then transported by its rotation to development station 34. At development station 34, sleeve 54 biased to V4 of −300 volts is relatively higher than drum 12 charged to V0 of −700 volts by +400 volts, allowing negatively charged residual toner particles 64 to be attracted to and collected by sleeve 54. Collected toner particles by sleeve 54 are reclaimed in the subsequent development.

Figure 4:
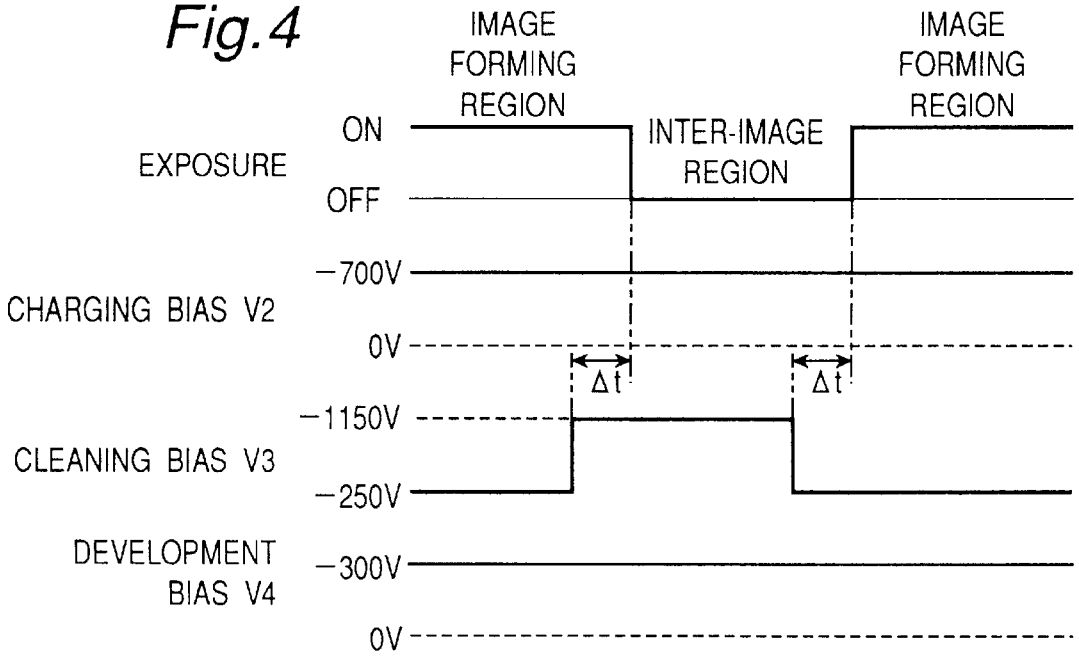
FIGS. 4 and 5 are time charts for describing timings at which a cleaning bias is changed.
Figure 5:
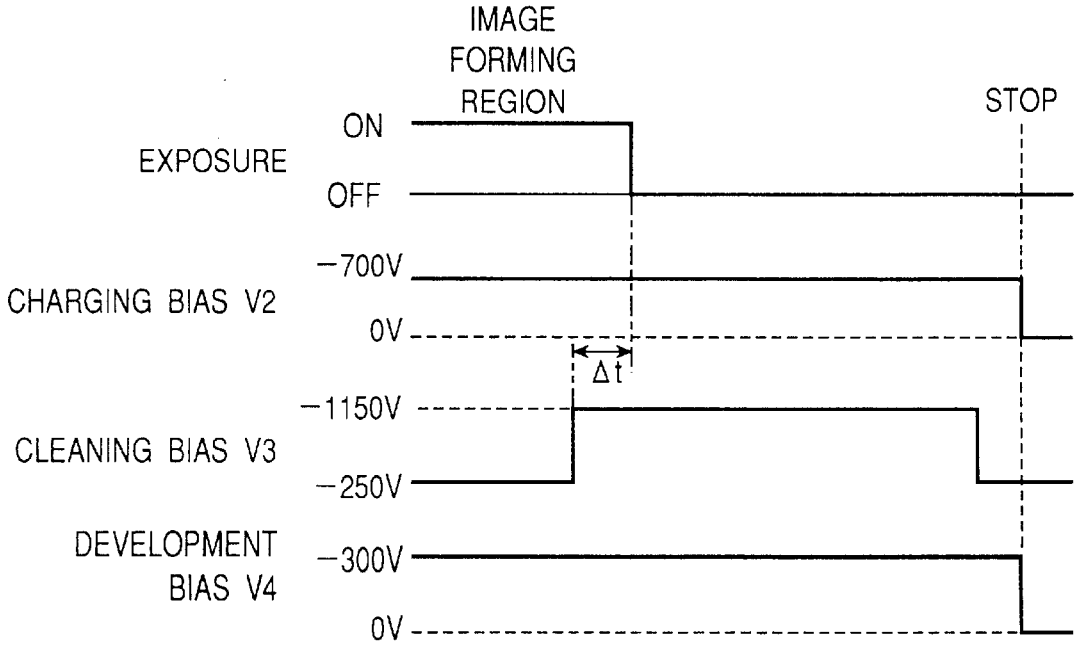

The second toner collecting process may be carried out when the image forming device is in the standby state or during an inter-image-forming period of time, i.e., between successive image forming processes. If the second collecting process is performed in the inter-image-forming time period, cleaning bias V3 is preferably controlled according to a time chart shown in FIG. 4. According to this, cleaning bias V3 is changed from −400 volts to −1,200 volts a specific time Δt before the completion of the exposure of light 32 and from −1,200 volts to −400 volts the same time at before the beginning thereof. The time Δt corresponds to a time in which a portion of drum 12 travels from cleaning station 22 to exposure station 28. If the second collecting process is performed after the final image forming has completed, as shown in FIG. 5, cleaning bias V3 is changed from −400 volts to −1,200 volts in the same manner and then turned off at the same time when the motor for driving drum 12 has been turned off.

(ii) SECOND EMBODIMENT

Figure 6:
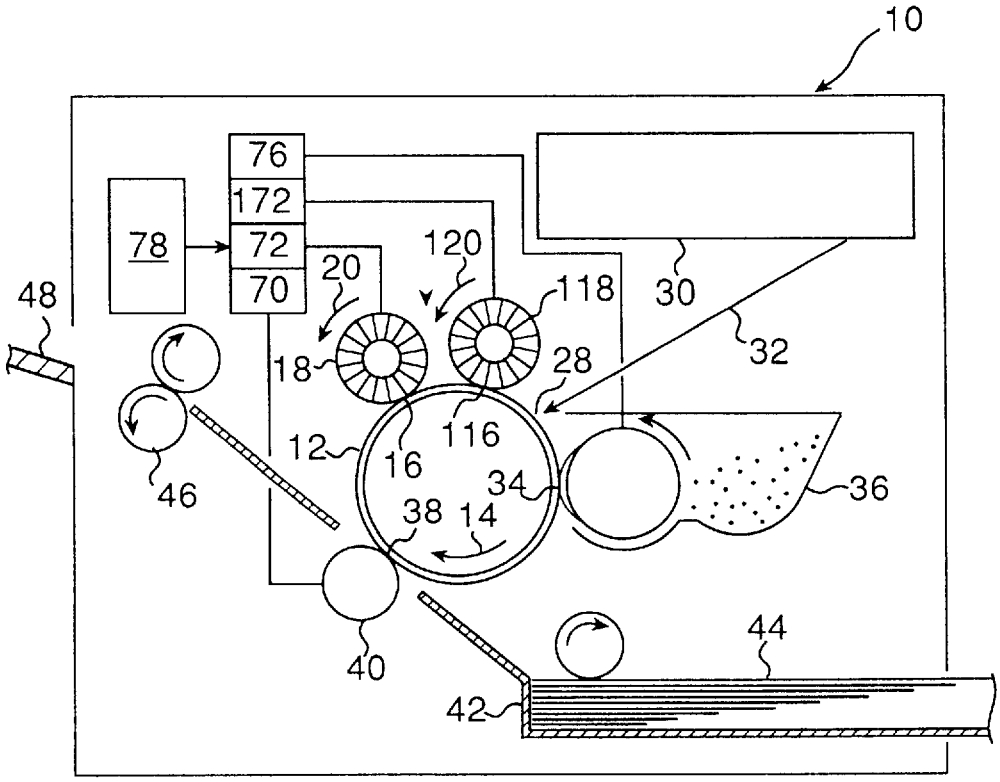
FIG. 6 is a sectional view of an image forming device of the second embodiment according to the invention.

FIG. 6 shows a second embodiment of the image forming device according to the invention in which an improvement is made thereto that a second charging brush 118 is added while the cleaning roller is eliminated therefrom. Charging brush 118 is the same as charging brush 18 and is supported for rotation in the direction of arrow 120 in circumferential contact with drum 12. Further, charging brush 118 is electrically connected to a power source 172 by which a bias V5 can be applied thereto.

Generally, with this embodiment, the residual toner particles on drum 12 are collected by first and second charging brushes 18 and 118 in the first collecting process and the collected toner particles are removed therefrom to drum 12 and then collected by developer 36.

For this purpose, charging brushes 18 and 118 and sleeve 54 are to be biased to potentials V2, V5, and V4, respectively, shown in the following Table 2:

TABLE 2

| | 1ST COLLECTING PROCESS | 2ND COLLECTING PROCESS |
|---|---|---|
| V2 | MAX −1,600 volts | −1,300 volts |
| | MIN 0 volts | |
| V5 | MAX −1,300 volts | −1,300 volts |
| | MIN −300 volts | |
| V4 | −300 volts | −300 volts |
| V0 | −800 volts | −800 volts |

Figure 7:
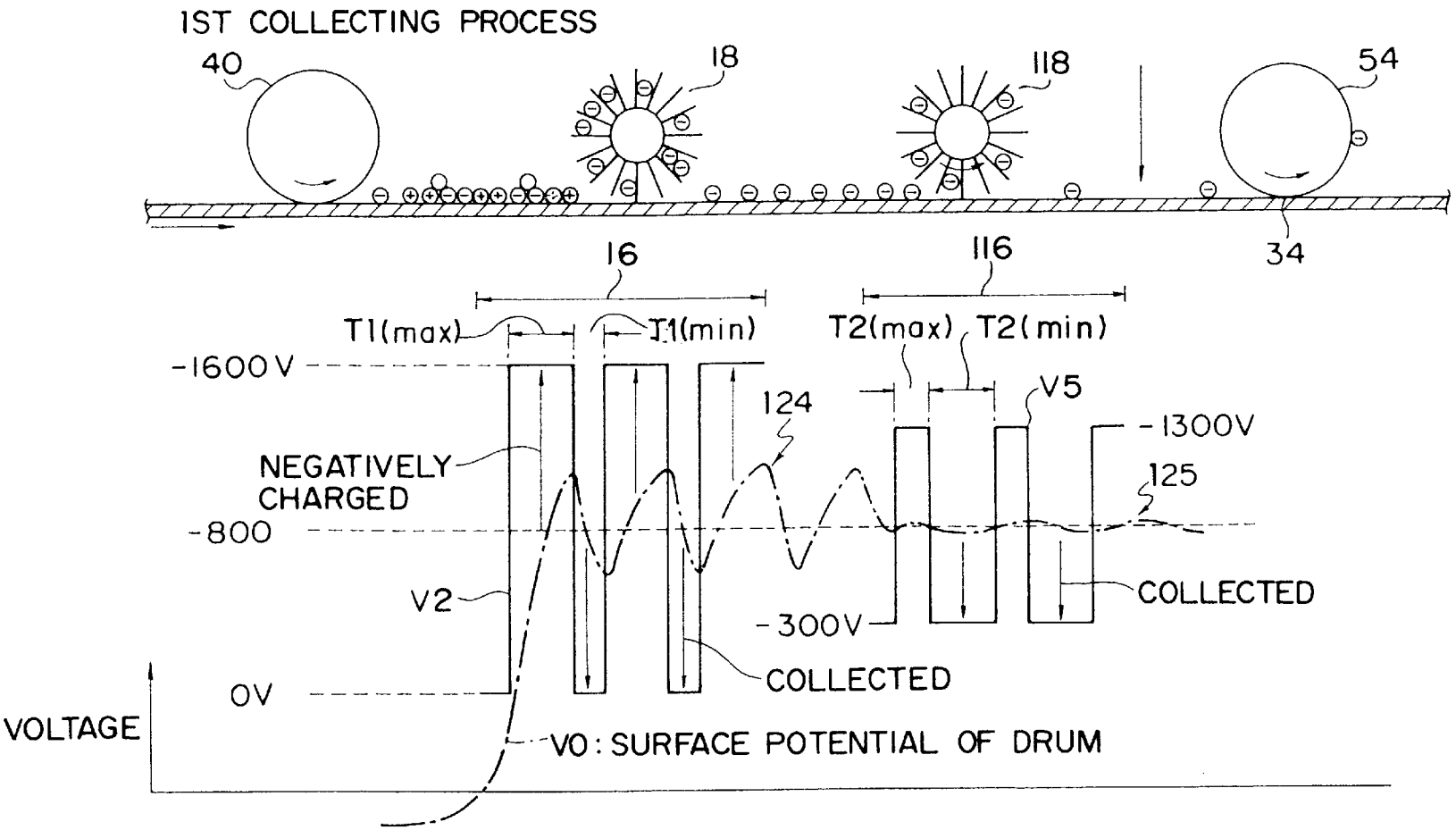
FIG. 7 shows the first collecting process of the second embodiment in which residual tone particles are collected by charging rollers.

Voltage waveforms of first and second charging biases V2 and V5 in the first collecting process are shown in FIG. 7. As illustrated, first charging bias V2 consists of square pulses having alternate maximum and minimum potential levels of −1,600 volts and zero volts, respectively. In each cycle, a duration T1(max) of the maximum potential is set to be twice as long as a duration T1(min) of the minimum potential. That is, a ratio of time period of the minimum potential over a time interval for the cycle is set to one-third. Accordingly, in the first collecting process, charging brush roll 18 charges drum 12 to about −1,100 volts when the maximum potential of −1,600 volts is biased there-so and discharges it to about −500 volts when the minimum potential of zero volts is biased thereto, and therefore the surface of drum 12 which has moved past the first charging station 16 has an average potential of about −800 volts.

Second charging bias V5, on the other hand, consists of square pulses having alternate maximum and minimum potentials of −1,300 volts and −300 volts, respectively. In each cycle, a duration T2(max) of the maximum potential is set to be a half of a duration T2(min) of the minimum potential. That is, a ratio of time period of the minimum potential over a time interval for the cycle is set to two-third.

With the above bias selection, although first charging brush roll 18 provides the surface of drum 12 with a voltage variation 124 of about 600 volts at first charging station 16, this voltage variation will be eliminated by second charging brush 118 at second charging station 116 thereby averaging the surface voltage of drum 12 to a desired level 125.

Specifically, in the first collecting process, at first charging station 16, the successive surface portions of drum 12 are charged to V0 of about −800 volts. Also, by the maximum potential of −1,600 volts biased to charging brush roll 18 and a discharge occurred thereby between brush roll 18 and drum 12, the wrong sign toner particles, i.e., positively charged toner particles, are negatively charge. When the minimum potential of zero volts is applied to charging brush 18, on the other hand, the negatively charged toner particles are collected to charging brush roll 18 due to the voltage difference between drum 12 (−800 volts) and charging brush roll 18 (minimum potential of zero volts). Collected toner particles having negative charge are then returned to drum 12 when the maximum potential of −1,600 volts is biased to charging brush 18, due to the voltage difference between drum 12 (−800 volts) and charging brush roll 18 (−1,600 volts). Thus, the residual toner particles travels across first charging station 16 while jumping between drum 12 and brush roll 18, thereby an image memory corresponding to the transferred toner image and formed by the residual toner particles is dissipated.

The primary function of first charging brush roll 18 is to impart the desired charge (i.e., negative charge) to the residual toner particles. This can be accomplished simply by applying a constant D.C. voltage, e.g., −1,300 volts, to charging brush roll 18. In this case, however, as the residual toner particles can hardly be dissipated, the image memory formed by the residual toner particles can be maintained on the surface portion of drum 12 which has moved past charging station 16. Contrary to this, according to the invention, maximum and minimum potentials, the voltage difference therebetween being 1,600 volts, are alternately applied to the charging brush roll and thereby the image memory formed by the residual toner particles is effectively dissipated and eliminated. Also, as the duration of the maximum potential is longer than that of the minimum potential, the wrong sign toner particles are charged to the desired polarity.

Figure 8:
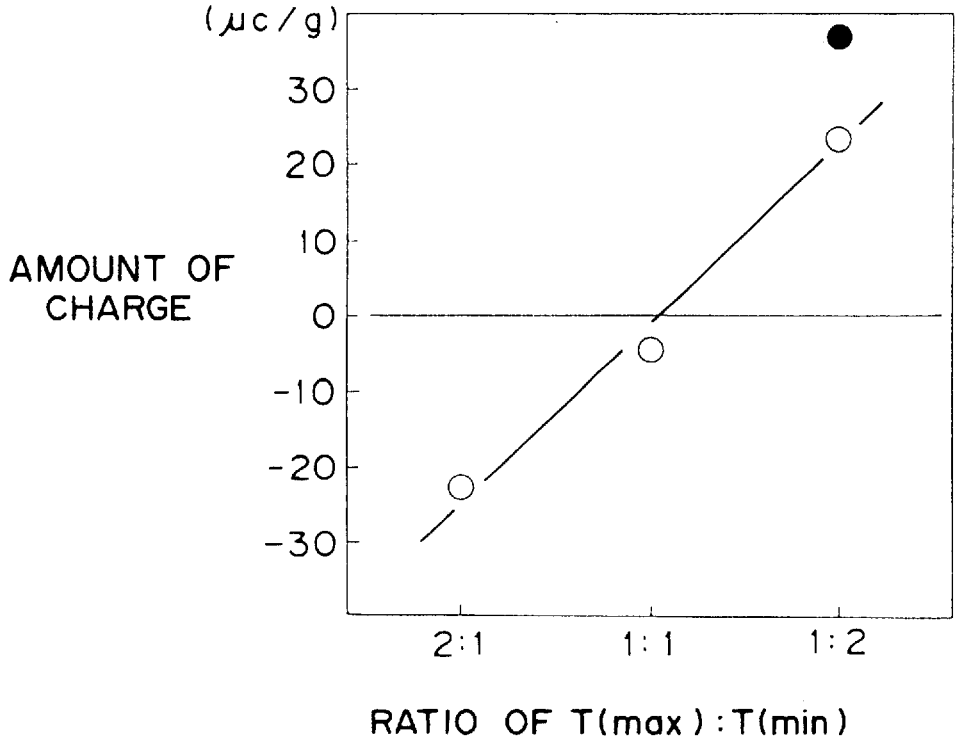
FIG. 8 is a graph which shows a relationship between a ratio of a duration time of maximum potential over that of minimum potential and an amount of charge of a wrong sign toner.

FIG. 8 is a graph which illustrates a relationship between the ratio of T(max) against T(min) and the amount of charge of the wrong sign toner particle that has moved past the first charging station 22. This shows that, if the ratio of T(min) :T(max) is 2:, the wrong sign toner particles can be changed to the desired polarity.

Referring again to FIG. 7, the toner particles moved past first charging station 16 are then transported to second charging station 116. At second charging station 116, second charging bias V5 having alternate maximum and minimum potentials of −1,300 volts and −300 volts and thereby the successive surface portions of drum 12 are charged to a potential of −800 volts. At this time, because the voltage difference between the maximum and minimum potentials is relatively small, i.e., 1,000 volts, the voltage variation 124 on drum 12 created at first charging station 16 is substantially eliminated.

Note that, at second charging station 116, the negatively charged toner particles which have not caught by first charging roll 18 are collected by second charging brush 118 when the minimum potential of −300 volts is applied to second charging brush 118 due to the voltage difference between drum 12 (−800 volts) and brush 118 (−300 volts). Although the negatively charged toner particles are subject to an attraction from charging brush 118 to drum 12 when charging brush 118 is biased to the maximum potential of −1,300 volts, since the duration T2(max) of the maximum potential is shorter than the duration T2(min) of the minimum potential, the toner particles remain adhering to charging brush 118 rather than move back to drum 12. As a result, the image memory on the drum, formed by the residual toner particles, is completely dissipated therefrom.

The primary function of second charging brush 118 is to collect the negatively charged toner particles not collected by the first brush 18, and thereby preventing them from being transported to exposure station 28. This is accomplished simply by applying a constant D.C. voltage (e.g., −500 volts) which is lower than the surface potential of drum 12 (i.e., −800 volts). However, to eliminate the surface voltage variation on the drum formed at first charging station 16, second charging brush 118 should be applied with the pulsating voltage as described.

Figure 9:
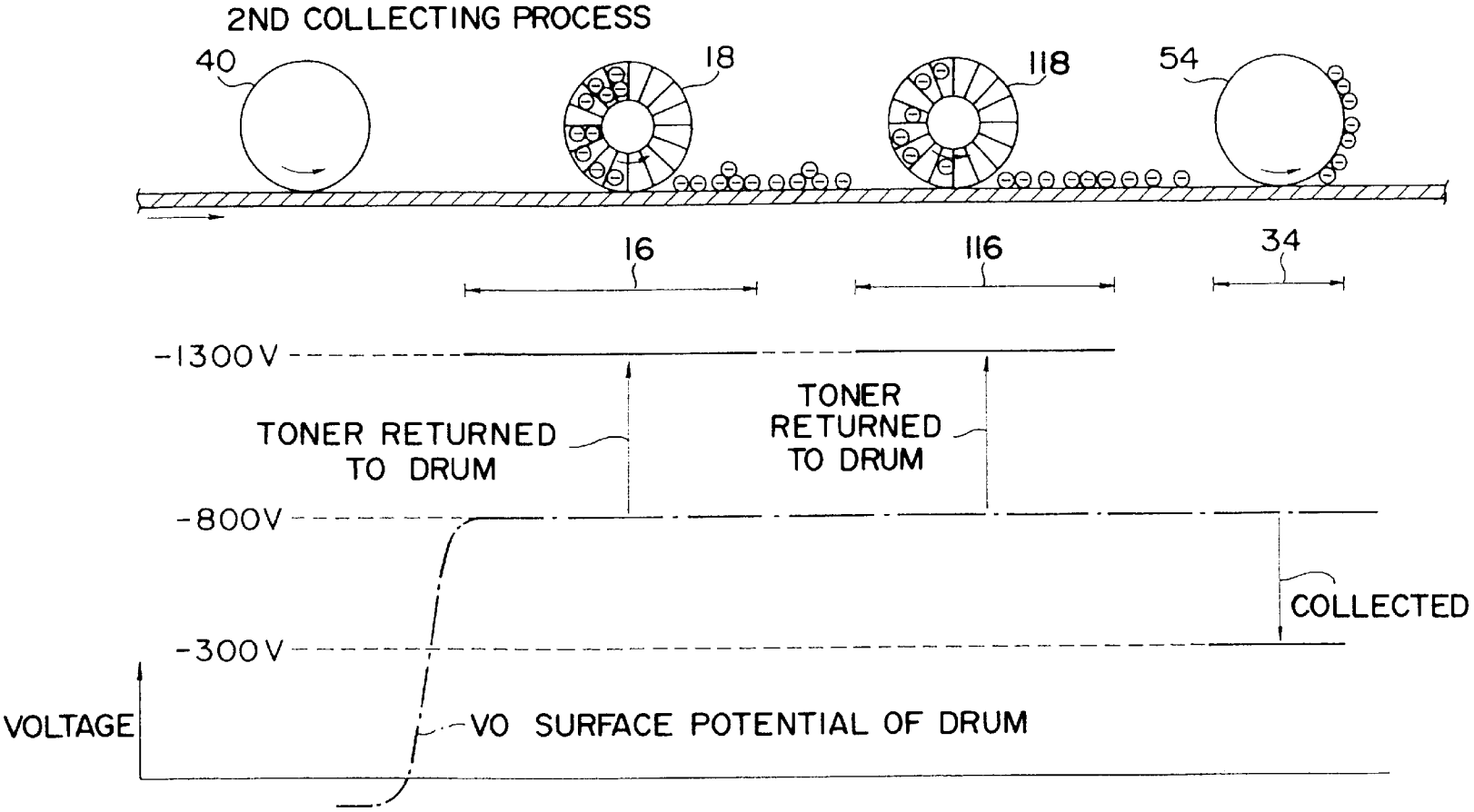
FIG. 9 shows the second collecting process of the second embodiment in which residual toner particles are collected by the developer.

In the second collecting process, both first and second charging biases V2 and V5 are set to −1,300 volts while development bias V4 is set to −300 volts. With this bias setting, successive surface portions of drum 12 are charged to about −800 volts when moving past first and second charging stations 16 and 116. As a result, as shown in FIG. 9, the negatively charged toner particles on charging brushes 18 and 118 are removed therefrom to drum 12 by the voltage difference of between brushes 18 and 118 both biased to −1,300 volts and drum 12 having surface potential of −800 volts. Then the toner particles are transported to development station 34 where they are collected by sleeve 54 due to the voltage difference of between sleeve 54 (−400 volts) and drum 12 (−800 volts).

Discussions will be made to the setting of durations T(max) and T(min). Experiments performed by the inventors has shown that, if the drum surface bears toner particles of about 0.05 mg per square centimeters, the projected light image is blocked by the toner particles and thereby results in image defects at the corresponding portion. Therefore, assuming that the electrostatic latent image is developed into an image having toner particles of 1.0 mg per square centimeters and then 80 percent thereof is transferred to the sheet substrate while 20 percent thereof is maintained after transfer. Also assuming that $\gamma 1$, i.e., T1(min)/[T1(max)+T1(min)], in first charging bias V2 is ⅓ and $\gamma 2$, i.e., T2(min)/[T2(max)+T2(min)], in second charging bias V5 is ⅔, as described. In this instance, the amount of toner particles remaining on the surface portion of drum 12 is determined as 0.044 mg per square centimeters, which is less than a limitation (0.05 mg per square centimeters) required for reproducing images free from defect possibly created if the image light is blocked by the residual toner particles, according to the following equation:

$$M \cdot (1-\eta) \cdot (1-\gamma 1) \cdot (1-\gamma 2)$$

$$= 1.0 \cdot (1-0.8) \cdot (1-1/3) \cdot (1-2/3)$$

$$= 0.044(\mathrm{mg/cm^2}) < 0.05(\mathrm{mg/cm^2})$$

where M represents the amount of toner provided by the developer, and $\eta$ represents the transfer rate.

It should be appreciated that, since M and $\eta$ change according to a duration of drum 12 and environment, the coefficients such as $\gamma 1$ and $\eta 2$ must be so determined to satisfy the above equation even in the worst condition for reproducing images free from defects.

(iii) THIRD EMBODIMENT

The image forming device of this embodiment is structurally identical to that of the first embodiment illustrated in FIG. 1. The biases V1 to V4, however, are set to levels shown in the following Table 3:

TABLE 3

| POTENTIAL | 1ST COLLECTING PROCESS | 2ND COLLECTING PROCESS |
|---|---|---|
| V1 | +400 volts | +400 volts |
| V2 | −1,350 volts | −1,250 volts |
| V3 | −250 volts | −1150 volts |
| V4 | −300 volts | −300 volts |
| V0 | −900 volts | −700 volts |
| (V0') | (−750 volts) | |

Figure 10A:
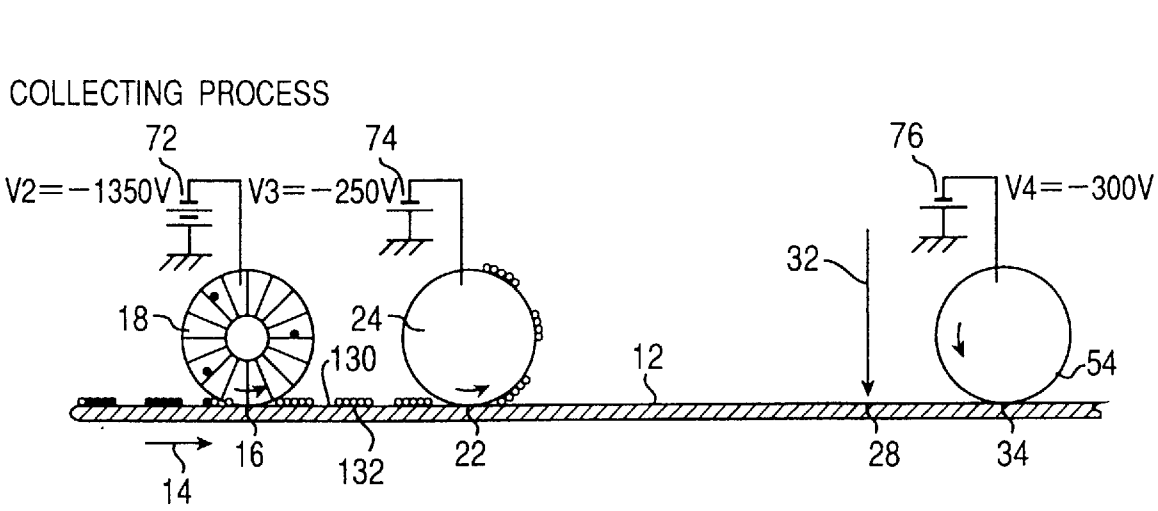
FIG. 10A shows the first collecting process in the third embodiment.

FIG. 10A illustrates the first collecting process in the image forming in which residual toner particles 64 on drum 12 are collected by the cleaning roller 24. In this process, as shown in Table 3, biases V1, V2, V3, and V4 are set to +400 volts, −1,350 volts, −250 volts, and −300 volts, respectively. Thereby, at transfer station 38 negatively charged residual toner particles 64 on drum 12 are transferred to sheet substrate 44 by the attraction of the transfer roller 40 biased to V1 of +400 volts.

Residual toner particles 64 are then transported to charging station 16. At charging station 16, charging brush 18 is biased to potential V2 of −1,350 volts. As a result, a discharge is occurred between charging brushes 18 and drum 12, which charges successive surface drum portions to a potential V0 of about −900 volts. At the same time, charging brush 64 also imparts negative charge to residual toner particles 64. By this charging, even the wrong sign toner particles are negatively charged.

Next, negatively charged residual toner particles 64 are then transported to cleaning station 22. At cleaning station 22, cleaning roller 24 is biased to the potential V3 of −250 volts which is relatively higher than charged potential V0 of −900 volts of drum 12 by +650 volts. This allows negatively charged residual toner particles 64 to be electrically attracted to and collected by the cleaning roller 24. Through the first collecting process, no residual toner particles will be transported to exposure station 28 during the image forming, which prevents the image light 32 from being blocked by the residual toner particles.

Figure 10B:
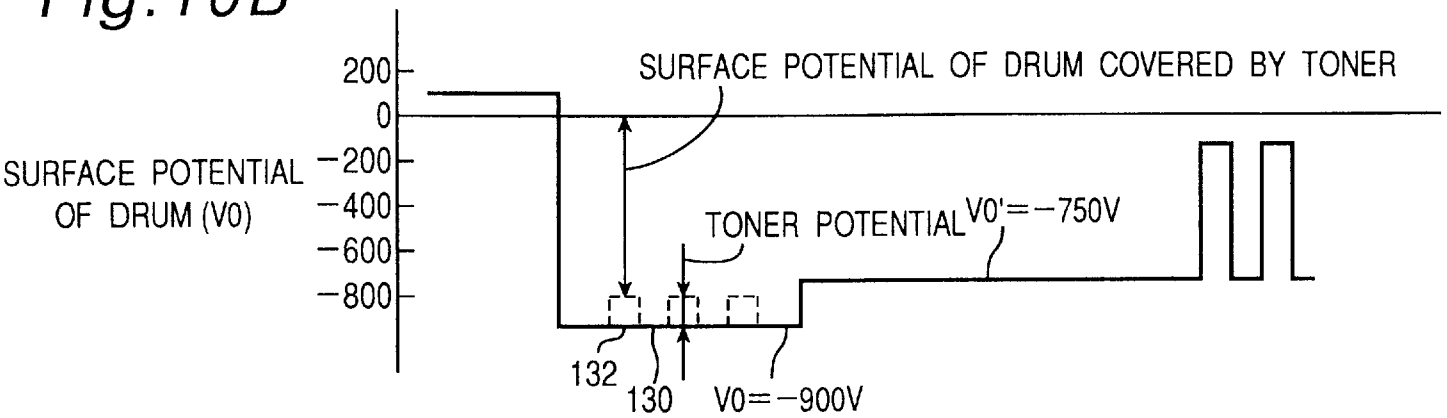
FIG. 10B shows a variation of the surface potential of drum in the first collecting process shown in FIG. 10A.

Incidentally, in the first collecting process, although a surface portion 130 of drum 12 bearing no toner particles 64 thereon is charged to the potential V0 of −900 volts at charging station 16, surface portions 132 of drum 12 bearing residual toner particles 64 thereon are not charged to the same level because of the existence of toner particles. Specifically, assuming that toner particles are charged to −50 volts in charging station 16. In this instance, surface portions 132 bearing toner particles are charged to only −850 volts as shown in dotted line in FIG. 10B. Therefore, the surface of drum 12 which has moved past the cleaning station 22 has a potential variation. As a result, in the electrostatic latent image having charged and discharged areas formed by the projection of image light 32 onto the surface of drum 12, the potential of surface portion 130 (i.e., −900 volts) differs from that of surface portion 132 (i.e., −850 volts), which in turn results in a variation of density in the resultant image.

To overcome this problem, in this embodiment, outputs of the power sources are determined so that an absolute value of a difference between an absolute value of cleaning bias V3 (i.e., 250 volts) and that of charged potential V0 of drum 12 (i.e., 900 volts) is greater than a minimum potential V(min) by which a discharge can be taken place between cleaning roller 24 and drum 12, i.e., $||V3|-|V0||>|V(min)|$.

With this bias setting, the discharge is brought about between cleaning roller 24 having potential V3 of −250 volts and the successive surface portion of drum 12 having potential V0 of −900 volts. This reduces the potential of the surface of drum 12 down to V0' of −750 volts (see FIG. 10B), the absolute value thereof being equal to a sum of the absolute voltages values of V3 (i.e., −250 volts) and V(min) (i.e., 450 volts).

Figure 11A:
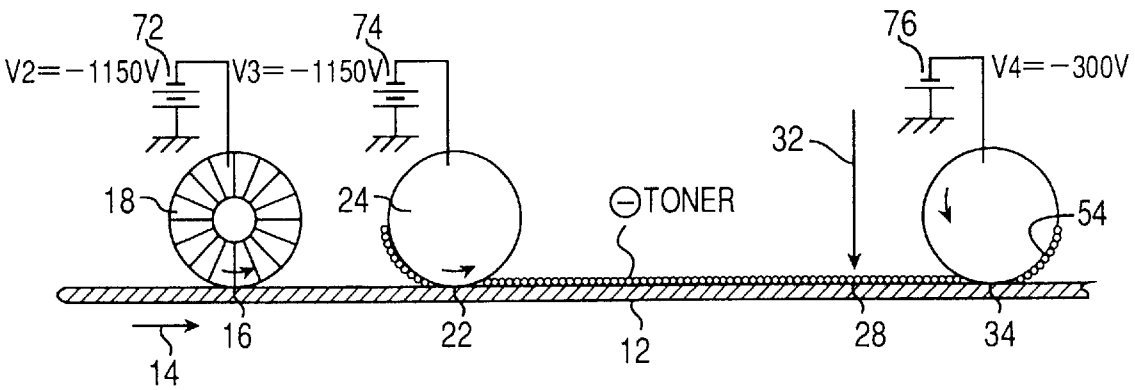
FIG. 11A shows the second collecting process in the third embodiment.
Figure 11B:
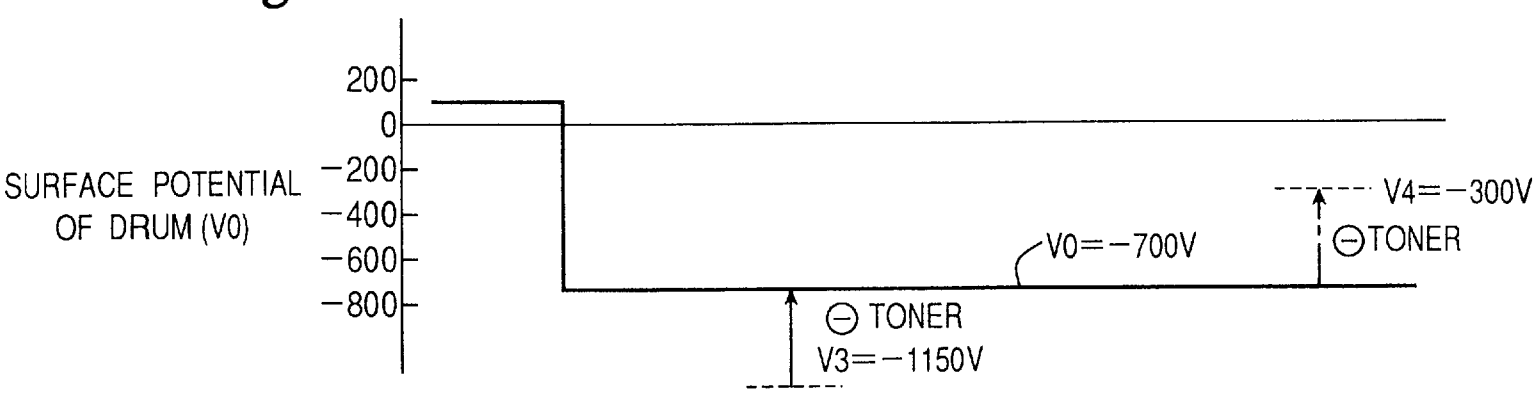
FIG. 11B shows a variation of the surface potential of drum in the second collecting process shown in FIG. 11A.

FIGS. 11A and 11B illustrates the second collecting process in which residual toner particles 64 on cleaning roller 24 are returned to drum 12 and then collected by sleeve 54. As shown in Table 3, in this second collecting process, biases V1, V2, V3, and V4 are set to +400 volts, −1150 volts, −1150 volts, and −300 volts, respectively. Alternatively, the transfer bias V1 may be turned off.

Thereby, the surface portion of drum 12 moved past charging station 16 and cleaning station 22 has a potential V0 of −700 volts. This potential V0 of −700 volts is relatively higher than the bias voltage V3 of −1,150 volts supplied to cleaning roller 24 by +450 volts, thereby negatively charged toner particles 64 supported on cleaning roller 24 are electrically attracted to drum 12. Toner particles 64 caught by drum 12 is transported by its rotation to development station 34. At development station 34, sleeve 54 biased to V4 of −300 volts is relatively higher than drum 12 having potential V0 of −700 volts by +400 volts, allowing negatively charged residual toner particles 64 to be attracted to and collected by sleeve 54. Collected toner particles by the sleeve 54 are reclaimed in the subsequent development.

Figure 12:
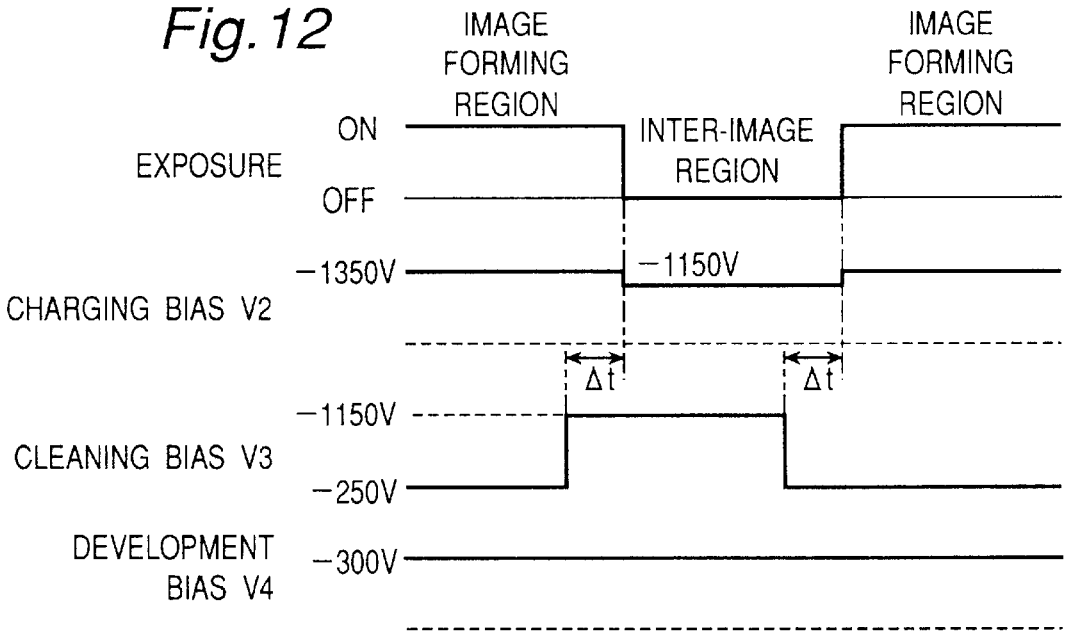
FIGS. 12 and 13 are time charts for describing timings at which a cleaning bias is changed in the third embodiment.
Figure 13:
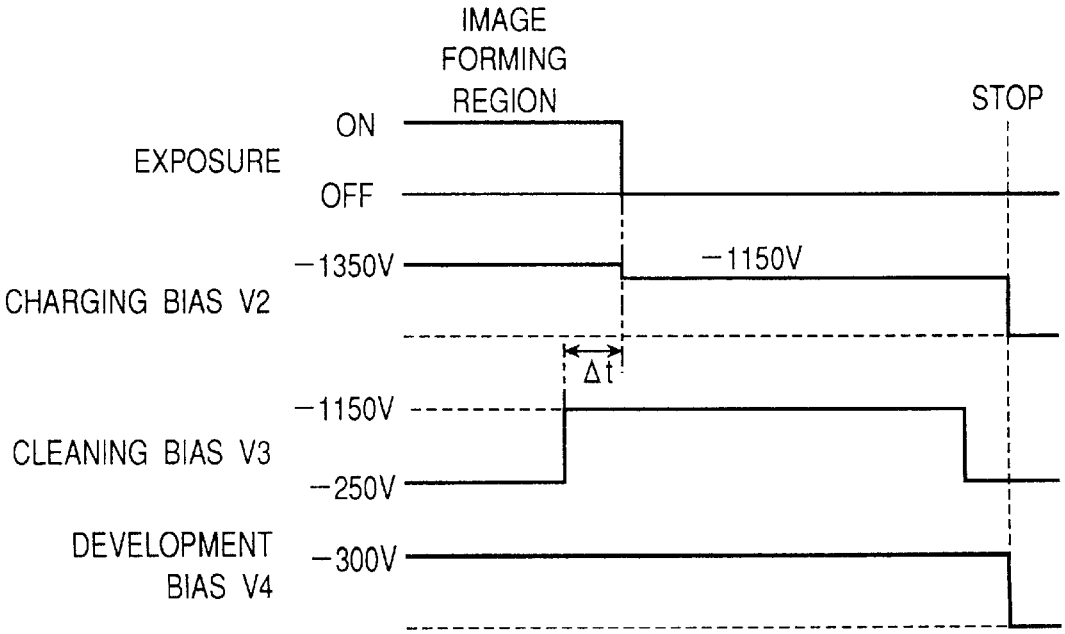

It should be appreciated that, as shown in FIGS. 12 and 13, if the second collecting process is performed in the inter-image-forming time period, cleaning bias V3 is changed from −250 volts to −1,150 volts a certain time Δt before the completion of the exposure and from −1,150 volts to −250 volts the same time Δt before the beginning thereof. The time Δt corresponds to a time in which a portion of drum 12 travels from cleaning station 22 to exposure station 28. If the second collecting process is performed after the final image forming has completed, as shown in FIG. 13, cleaning bias V3 is changed from −250 volts to −1,150 volts in the same manner and then turned off at the same time when the motor for driving drum 12 has been turned off.

(iv) FOURTH EMBODIMENT

Figure 14:
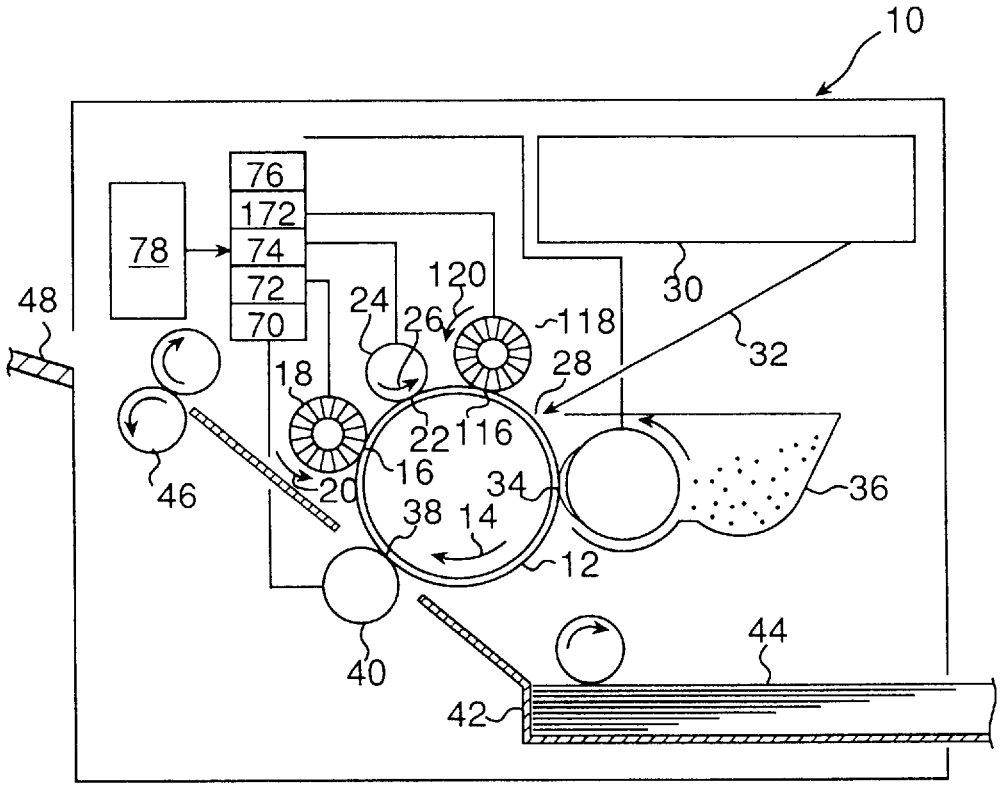
FIG. 14 is a sectional view of the image forming device of the fourth embodiment according to the invention.

FIG. 14 shows a fourth embodiment of the image forming device according to the invention. In this embodiment, cleaning roll 24 and second charging brush 118 are disposed between first charging station 16 and exposure station 28. The potential V2, V3, V4, and V5 are changed depending upon the collecting processes as shown in the following Table 4:

TABLE 4

| POTENTIAL | 1ST COLLECTING PROCESS | 2ND COLLECTING PROCESS |
|---|---|---|
| V2 | −1,100 volts | −1,100 volts |
| V3 | −300 volts | −1,100 volts |
| V4 | −300 volts | −300 volts |
| V5 | −1,200 volts | −1,200 volts |
| V0 | −650 volts | −650 volts |
| (V0') | (−750 volts) | (−750 volts) |

Figure 15A:
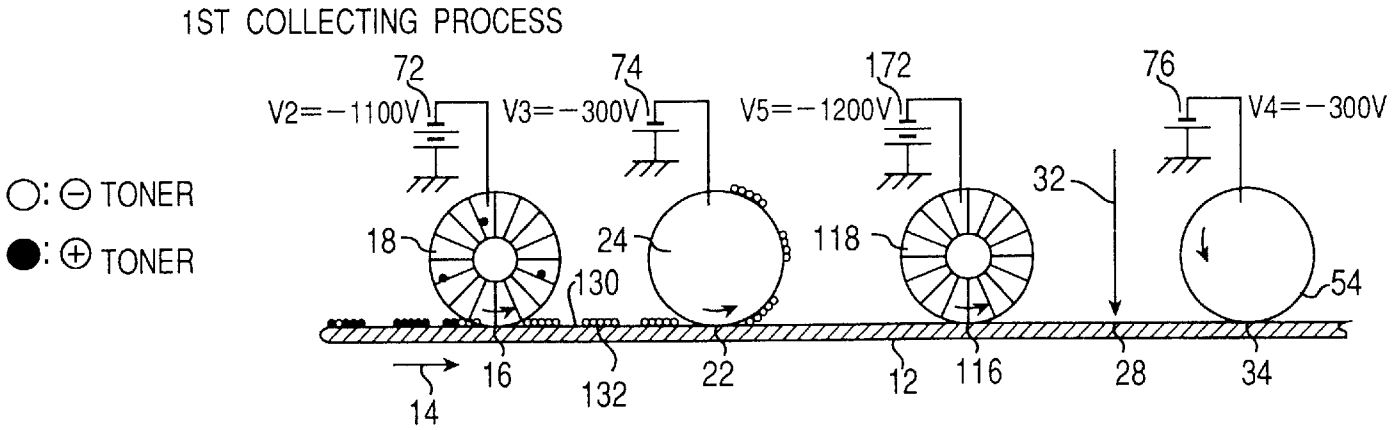
FIG. 15A shows the first collecting process in the fourth embodiment.

According to this image forming device, in the first collecting process, as shown in FIG. 15A, at charging station 16, a discharge is occurred between charging brush 18 biased to potential V2 of −1,100 volts and drum 12, causing the surface of drum 12 to be charged to a potential V0 of about −650 volts. At this time, residual toner particles 64 are negatively charged.

Next, at cleaning station 22, negatively charged residual toner particles 64 are collected by cleaning roller 24 by the difference between cleaning bias V3 of −300 volts and charge potential V0 of −650 volts. At this stage, the potential difference between V3 and V0 is less than minimum potential difference V(min), i.e., 450 volts, by which a discharge can be taken place between cleaning roller 24 and drum 12 and therefore no discharge is occurred therebetween. This maintains the potential variation on the surface of drum 12, i.e., one surface portion 130 bearing no residual toner particle has a potential of −650 volts while the other surface portions 132 bearing residual toner particles has a potential of −600 volts if it is assumed that residual toner particles are charged to −50 volts.

Figure 15B:
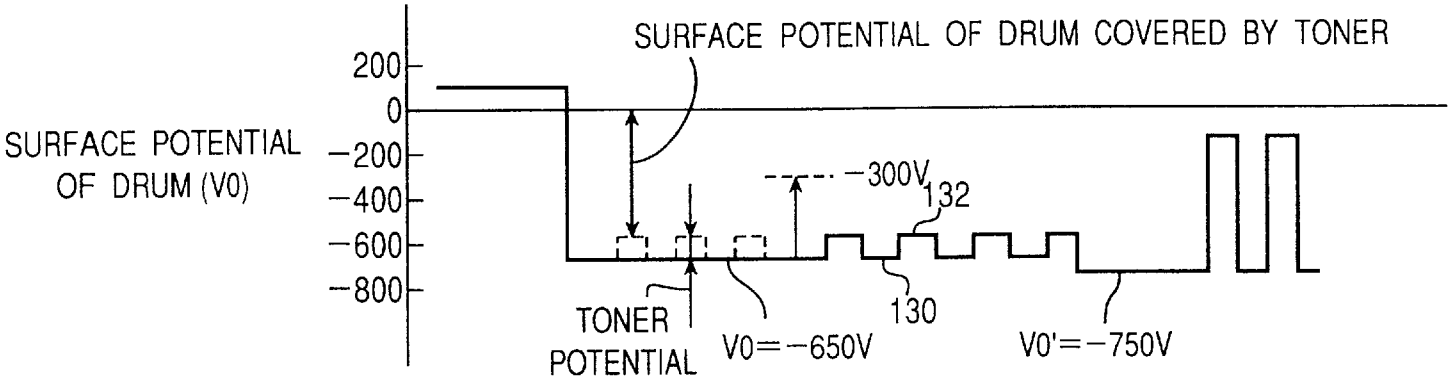
FIG. 15B shows a variation of the surface potential of drum in the fourth collecting process shown in FIG. 15A.

In this embodiment, however, a charging bias V5 of −1,200 volts is supplied to second charging brush 118. Then, potential differences between charging brush 118 and surface portions 130 and 132 on drum 12 are 550 volts and 600 volts, respectively, which are greater than the minimum potential difference V(min) of 450 volts required for discharging. Therefore, the discharge is occurred between the successive surface portions of drum 12 and charging brush 118, thereby charging the successive portions of drum 12 to an potential V0' of −750 volts as shown in FIG. 15B.

Consequently, no residual toner particles will be transported to exposure station 28 thereby preventing the image light 32 from being blocked by the residual toner particles. Also, the surface of drum 12 has an uniform potential and therefore the electrostatic latent image having desired potential is formed, which ensures a high quality image having no density variation to be reproduced.

Figure 16A:
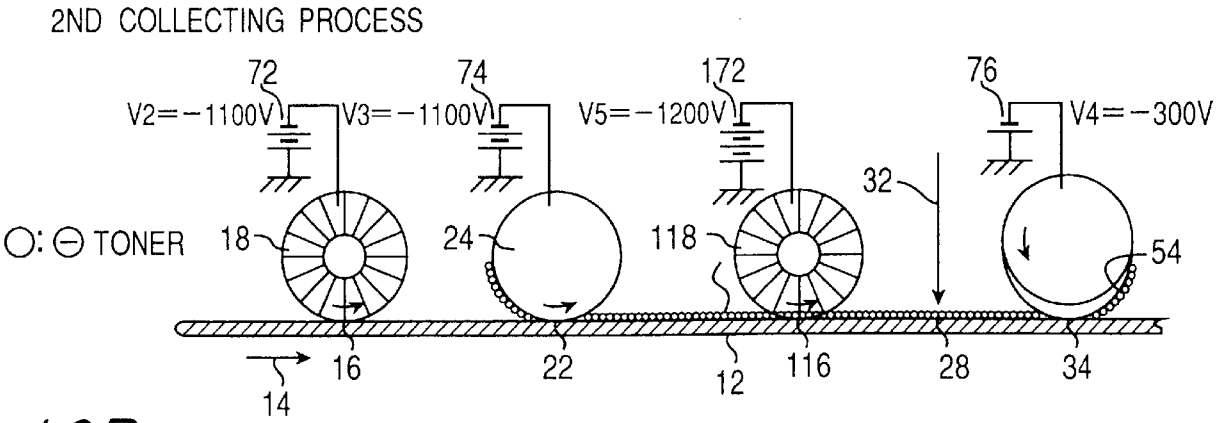
FIG. 16A shows the second collecting process in the fourth embodiment.
Figure 16B:
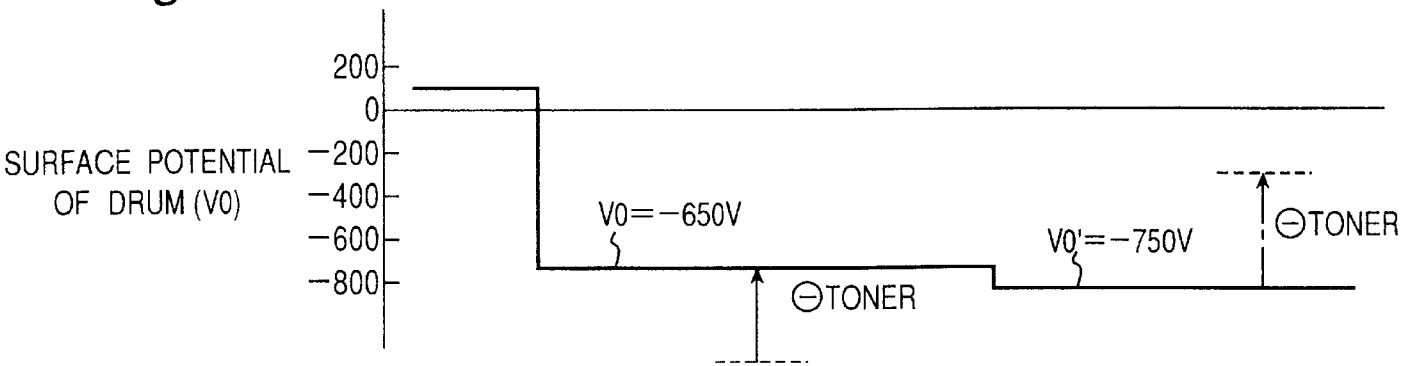
FIG. 16B shows a variation of the surface potential of drum in the second collecting process shown in FIG. 16A.

As shown in FIGS. 16A and 16B and Table 3, in the second collecting process in which bias levels V2, V3, V4, and V5 are set to −1,100 volts, −1,100 volts, −300 volts, and −1500 volts, respectively.

With this bias setting, the surface portion of drum 12 which has moved past through charging station 16 is charged to a potential V0 of −650 volts. Next, at cleaning station 22, negatively charged residual toner particles 64 are returned to drum 12 by the difference between cleaning bias V3 of −1,100 volts of cleaning roller 24 and surface potential V0 of −650 volts of drum 12. Subsequently, at second charging station 116, a discharge is occurred by the difference between charging bias V5 of −1,200 volts of charging brush 118 and surface level V0 of −650 volts of drum 12, thereby the surface of drum 12 is charged up to a potential V0' of −750 volts. Then toner particles 64 on drum 12 is transported to development station 34. At development station 34, toner particles on the drum 12 are attracted to and collected by sleeve 54 by the difference between development bias V4 of −300 volts and surface potential V0' of −750 volts. Collected toner particles by the sleeve 54 are reclaimed in the subsequent development.

(v) MODIFICATIONS

Figure 17:
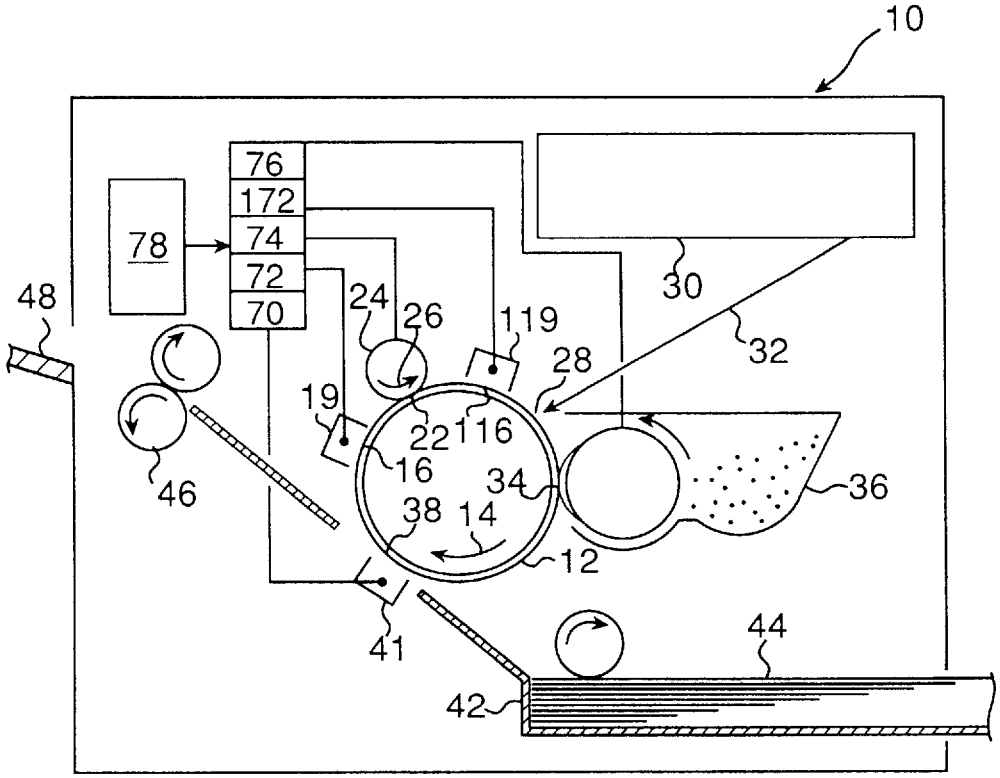
FIG. 17 is a sectional view of the image forming device of the modification in which charging brushes are replaced by corona chargers.

FIG. 17 shows a modification of the image forming device. In this arrangement, corona chargers 19 and 119 are employed in place of charging brushes 18 and 118, respectively. Also, a corona charger 41 is employed in place of transfer roller 40. According to this arrangement, similar to the aforementioned embodiments, the residual toner particles can be collected by developer 36.

It should be noted that charging brushes 18 and 118 are arranged in circumferential contact with drum 12 and therefore some toner particles can adhere to bristles of the brush thereby reducing a charging property of the brush. Also, not all the wrong sign positively charged toner particles can be reversely charged, i.e., negatively charged, by the contact of the charging brush and some wrong sign toner particles can maintain the positive charge even after the contact thereof and adhere thereto.

Figure 18:
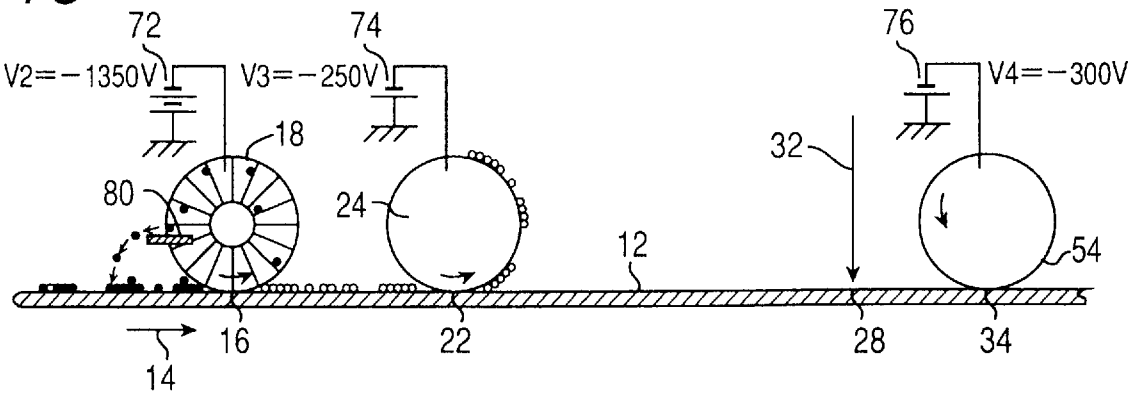
FIG. 18 shows another modification in which a scraper is arranged to remove wrong sign toners from the brush.

To remove the wrong sign toner particles from the brush, as shown in FIG. 18, a scraper 80 is preferably arranged in contact with the rotating bristles of brush 18 so that the toner particles adhering to the bristles can be removed therefrom onto a surface portion of drum 12 on an upstream side of charging station 16 with respect to the rotational direction of drum 12 and then transported to charging station 16 again.

Figure 19:
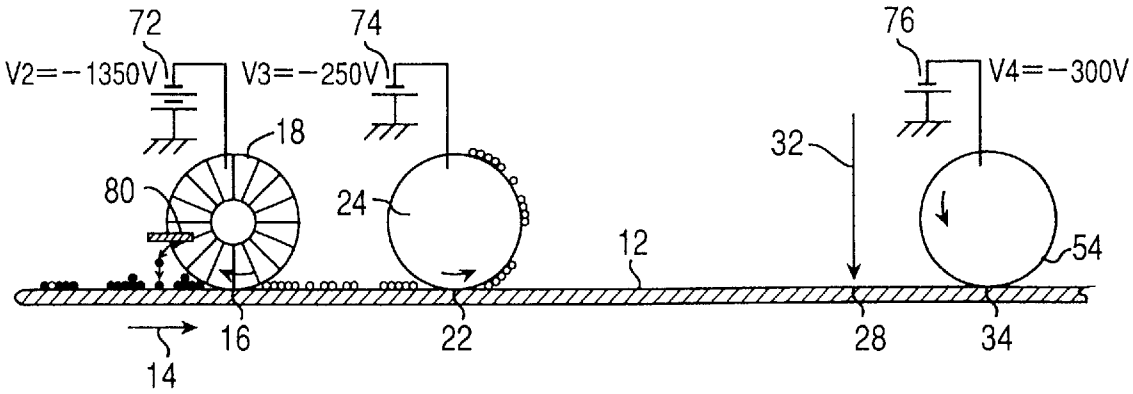
FIG. 19 shows another modification in which the brush rotates in an opposite direction.

Although charging brush 18 is rotated counterclockwise in the arrangement, it may be rotated clockwise. In this instance, as shown in FIG. 19, the scraper may be disposed in the same position so that the toner particles on the brush are returned onto a surface portion of the drum which will be subsequently advanced to the charging station for charging the removed toner particles thereat.

Figure 20:
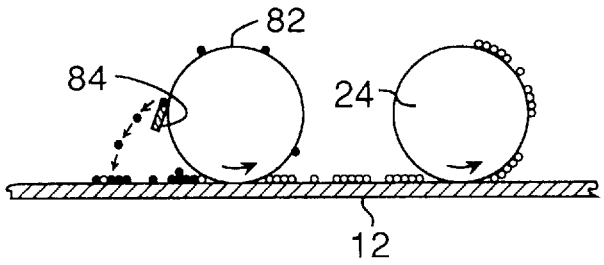
FIG. 20 shows another modification in which a roller-type charging member is employed.

As shown in FIG. 20, a roller-type charging means, i.e., charging roller 82, may be replaced by the brush. In this case, a scraper 84 is advantageously arranged in contact with charging roller 82 so that residual toner particles thereon can be removed therefrom.

Figure 21:
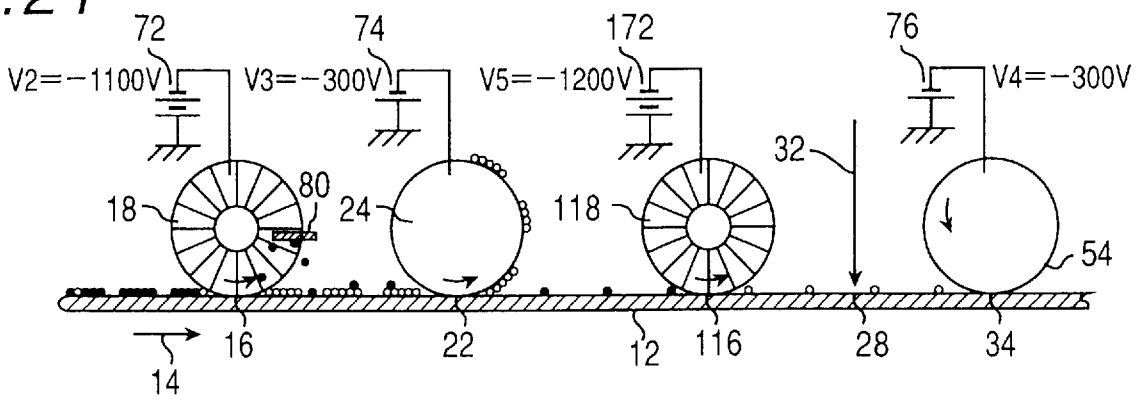
FIG. 21 shows another modification in which the scraper is arranged in different manner.

As shown in FIG. 21, scraper 80 may be so disposed that the removed toner particles are dropped onto a surface portion of drum 12 which has already moved past charging station 16. In this instance, the wrong sign toner retained on drum 12 repels against cleaning roller 24 and then moves past cleaning station 22. Therefore, the second charging brush 118 is preferably disposed between cleaning station 22 and exposure station 28 so that the wrong sign toner is charged to the desired polarity, i.e., negative polarity in this embodiment. The toner particles charged by charging brush 118 are then transported to exposure station 28 through, as the quantity thereof is limited and they are scattered in all directions at charging stations 16 and 116, no harmful defect is provided to the resultant image. The toner particles moved past exposure station 28 are collected by sleeve 54 at development station 34.

Figure 22:
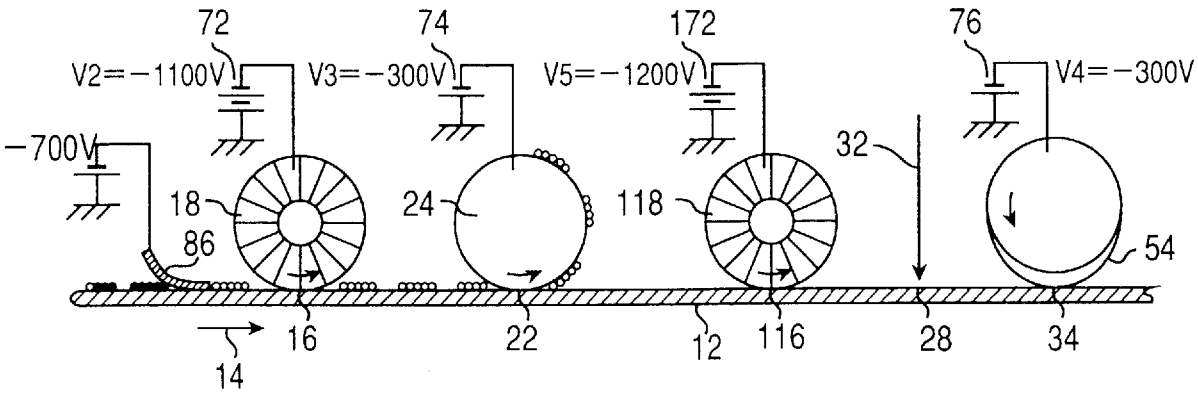
FIG. 22 shows another modification in which a precharging member is incorporated.

FIG. 22 shows another modification of the invention in which a precharging member 86 is arranged between transfer and charging stations 38 and 16. Precharging member 86 is preferably made from a film-like sheet capable of provide toner particles with the desired polarity, i.e., negative polarity in the above-described embodiments by the contact therewith. According to this arrangement, the wrong sign toner particle are reversely charged to the desired polarity by the contact with precharging member 86 before entering charging station 16, which reduces the amount of toner particles to be disadvantageously caught by charging brush 18 and thereby prevents brush 18 from being polluted. Precharging member 86 is preferably biased to a potential which has the same polarity as and equal to or less (e.g., −700 volts in the previous embodiment) than those of charging bias to be supplied to charging brush 18.

Although the brush is employed to charge the drum, various types of charging means such as corotoron-type, roller-type, and blade-type chargers may be employed in the invention. Also, although various types of cleaning means such as brush-type and belt-type cleaner may be used in the invention, the roller-type cleaner illustrated in the drawings is most preferably used because it can not only provide a reliable toner collection but prevent an unwanted discharge between the cleaner and the drum which would possibly result in noises or memory of previous image in the resultant image.

The toner particles collected by the cleaner may be electrically or mechanically transported to a container or further conveyed to the developer from the container.

Although it is not necessary to keep the biases, i.e., cleaning, charging, and development biases, constant in the toner collecting processes, in case of a digital image forming apparatus, they may be changed depending on an amount of residual toner particles which can be estimated by counting the number of dots to be printed.

The invention can be applied to an image forming apparatus in which a two-component developer consisting of toner and carrier particles is incorporated.

Further, it should be appreciated that the polarities of toner particle and biases and levels of bias potentials are not limited to the embodiment, they may be selected according to the concept of the invention.

What is claimed is:

1. An image forming apparatus comprising:

image bearing member;

charging means for charging said image bearing member;

exposure means for exposing said charged image bearing member to form an electrostatic latent image thereon;

developing means for bringing a developer material into contact with said image bearing member to develop said electrostatic latent image into a visualized image, said developer material having the same electric charge as said charged image bearing member; and transfer means for transferring said visualized image to a receiving substrate;

wherein said developer material remaining on said image bearing member after transfer of said visualized image to said receiving substrate is collected by said developing means, said apparatus further comprising:

cleaning means, arranged between said charging means and said exposure means in contact with said image bearing member, for collecting residual developer material remaining on said image bearing member; and biasing means comprising:

controlling means for controlling said biasing means to apply a charging bias, a cleaning bias, and a development bias to said charging, cleaning, and development means, respectively, and when an image forming process is carried out in said image forming apparatus, said charging bias is so set that said image bearing member is charged to a certain potential and residual toner particle on said image bearing member is charged to a polarity the same as potential of said charged image bearing member, and said cleaning bias being set having a polarity the same as said potential of said charged image bearing member and said cleaning bias being set having an absolute value smaller than said potential of said charged image bearing member for collecting said residual developer material from said image bearing member to said cleaning means.

2. Apparatus as claimed in claim 1, wherein, when said image forming process is not carried out, said cleaning bias being set having a polarity the same as said potential of said image bearing member and an absolute value greater than said potential of said image bearing member, thereby allowing toner particles on said cleaning means to be removed from said cleaning means to said image bearing member, and said development bias being set having a polarity the same as said potential of said image bearing member and an absolute value smaller than said potential of said image bearing member, thereby allowing said toner particles on said image bearing member to be collected by said developing means.

3. An image forming apparatus comprising:

a rotatable image bearing member;

charging means for charging said image bearing member;

exposure means for exposing said charged image bearing member to form an electrostatic latent image thereon;

developing means for developing said electrostatic latent image into a visualized image using a developer material having an electric charge of specific polarity identical to that of said charged image bearing member; and transfer means for transferring said visualized image to a receiving substrate before said charging;

said charging means further comprising a first charging means, a second charging means arranged on downstream side of said first charging means with respect to a rotational direction of said image bearing member, and a power supply means for supplying a first and a second biases to said first and second charging means, respectively, so that said first and second charging means charge said image bearing member and collecting said developer material which remains on said image bearing member after said transfer, each of said first and second biases consisting of alternate maximum and minimum potentials, a voltage difference between said maximum and minimum potentials in said first bias is greater than that in said second bias, in said first bias a duration of said maximum potential being longer than that of said minimum potential, and each of said first and second biases being determined to satisfy the following relation:

$$M\cdot(1-\eta)\cdot(1-\gamma 1)\cdot(1-\gamma 2)<0.05\ (\mathrm{mg/cm2})$$

where M represents an amount of said developer material in per area in said visualized image, $\eta$ represents a transfer rate of said developer material from said image bearing member to said receiving substrate by said transfer means, $\gamma 1$ represents a ratio of said duration of said minimum potential against a recurrence time in said first bias, and $\gamma 2$ represents ratio of a duration of said minimum potential against a recurrence time in said second bias.

4. An image forming apparatus comprising:

a rotatable image bearing member;

charging means for charging said image bearing member;

exposure means for exposing said charged image bearing member to form an electrostatic latent image thereon;

developing means for developing said electrostatic latent image into a visualized image using a developer material having an electric charge of specific polarity identical to that of said charged image bearing member; and transfer means for transferring said visualized image to a receiving substrate before said charging;

said charging means further comprising a first charging means, a second charging means arranged on downstream side of said first charging means with respect to a moving direction of said image bearing member, and a power supply means for supplying a first and a second biases to said first and second charging means, respectively, so that said first and second charging means charge said image bearing member and collect said developer material which remains on said image bearing member after said transfer, each of said first and second bias consisting of alternate maximum and minimum potentials, in said first bias a duration of said maximum potential being longer than that of said minimum potential, in said second bias a duration of said maximum potential is shorter than that of said minimum potential.

5. An image forming apparatus comprising:

a rotatable image bearing member;

charging means for charging said image bearing member;

exposure means for exposing said charged image bearing member to form an electrostatic latent image thereon;

developing means for developing said electrostatic latent image into a visualized image using a developer material having an electric charge of specific polarity identical to that of said charged image bearing member; and transfer means for transferring said visualized image to a receiving substrate before said charging;

said charging means further comprising a first charging means, a second charging means arranged on downstream side of said first charging means with respect to a moving direction of said image bearing member, and a power supply means for supplying a first and a second biases to said first and second charging means, respectively, so that said first and second charging means charge said image bearing member and collect said developer material which remains on said image bearing member after said transfer, each of said first and second bias consisting of alternate maximum and minimum potentials, a voltage difference between said maximum and minimum potentials in said first bias being greater than that in said second bias, in said first bias a duration of said maximum potential is longer than that of said minimum potential, in said second bias a duration of said maximum potential is shorter than that of said minimum potential.

6. An image forming apparatus, comprising:

an image bearing member;

a first charging means for charging said image bearing member;

exposure means for exposing said charged image bearing member to form an electrostatic latent image thereon;

developing means for developing said electrostatic latent image into a visualized image using a developer material;

transfer means for transferring said visualized image to a receiving member; and collecting means for collecting said developer material remaining on said image bearing member after said transfer but before said charging;

wherein, in an image forming process, said first charging means provides said image bearing member and residual developer material with an electric charge having a specific polarity, said collecting means is biased to a potential, said potential having a polarity the same as said image bearing member to provide said image bearing member with the similar electric charge and having an absolute value lower than that of said charge of said image bearing member so that residual developer material remaining on said image bearing member is collected by said collecting means.

7. An apparatus claimed in claim 6, wherein, when said image forming process is not carried out, said collecting means is biased to a potential, said collecting means potential having an absolute value greater than that of said electric charge of said image bearing member and said developing means is biased to a potential, said developing means potential having an absolute value greater than that of said electric charge of said image bearing member, so that said developer material collected by said collecting means in said image forming process is returned to said image bearing member and then collected by said developing means.

8. An apparatus claimed in claim 6, wherein, in said image forming process, a voltage difference between said collecting means and said image bearing member is set to be greater than that required for bringing about a discharge there between, for discharging said image bearing member.

9. An apparatus claimed in claim 6, wherein second charging means is disposed between said collecting means and said exposure means, and a bias potential to be charged to said second charging means in said image forming process has an absolute value greater than that of a bias potential to be charged to said first charging means.

10. An apparatus claimed in claim 9, wherein at least one of said first and second charging means includes a charging member arranged in contact with said image bearing member for charging it and a scraper for scraping said developer material away from said charging member to said image bearing member.

11. An apparatus claimed in claim 9, wherein at least one of said first and second charging means includes a charging member arranged in contact with said image bearing member for charging it, and said apparatus further includes precharging member so arranged to contact with said developer material on said image bearing member on an upstream side of said charging member with respect to a movement direction of said image bearing member, said precharging member being supplied with a bias having an absolute value equal to or less than a bias to be supplied to said charging member.

12. An image forming apparatus for reclaiming a residual developer material, comprising:

a rotatable image bearing member supporting an endless image bearing surface;

first charging means, arranged in contact with said image bearing surface, for imparting a first electric charge to said image bearing surface;

second charging means, arranged on a downstream side of said first charging means with respect to a rotational direction of said image bearing member in contact with said image bearing surface, for imparting a second electric charge having the same polarity as said first electric charge to said image bearing surface;

exposure means for exposing said charged image bearing surface to form an electrostatic latent image thereon;

developing means which includes a developer material having the same polarity as said second electric charge on said image bearing surface so that said electrostatic latent image is developed by said developer material into a visualized image on said image bearing surface; and transfer means, arranged between said developing means and said first charging means, for transferring said visualized image to a receiving member.

13. An apparatus claimed in claim 12, wherein said second electric charge imparted by said second charging means to said image bearing surface is higher than said first electric charge imparted by said first charging means thereto.

14. An apparatus claimed in claim 12, wherein said first charging means is a roller-type or brush-type electric charger and said second means is a roller-type or brush-type electric charger.

15. An apparatus claimed in claim 12, wherein either or both of said first and second charging means collect said developer material which remains on said image bearing surface after said transfer.

16. An apparatus claimed in claim 12, wherein each of said first and second charging means collects said developer material which remains on said image bearing surface after said transfer, and said second charging means collects more developer material than said first charging means.

* * * * *

UNITED STATES PATENT AND TRADEMARK OFFICE

CERTIFICATE OF CORRECTION

PATENT NO. : 5,832,336

DATED : November 3, 1998

INVENTOR(S) : Akihiro KAWASAKI et al.

It is certified that error appears in the above-identified patent and that said Letters Patent is hereby corrected as shown below:

Col. 20, line 15, after "second" insert --charging--.

Signed and Sealed this

First Day of June, 1999

*Attest:*

Q. TODD DICKINSON

*Attesting Officer*

*Acting Commissioner of Patents and Trademarks*